US006623901B1

(12) United States Patent
Kohtaki et al.

(10) Patent No.: US 6,623,901 B1
(45) **Date of Patent: *Sep. 23, 2003**

(54) TONER FOR DEVELOPING ELECTROSTATIC IMAGE

(75) Inventors: Takaaki Kohtaki, Yokohama (JP); Makoto Unno, Tokyo (JP); Yushi Mikuriya, Kawasaki (JP); Tadashi Doujo, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 66 days.

(21) Appl. No.: 08/992,427

(22) Filed: Dec. 18, 1997

Related U.S. Application Data

(63) Continuation of application No. 08/361,526, filed on Dec. 22, 1994, now abandoned.

(30) Foreign Application Priority Data

Dec. 29, 1993 (JP) ..... 5-354164
May 13, 1994 (JP) ..... 6-123295
Aug. 5, 1994 (JP) ..... 6-203024

(51) Int. Cl.[7] ..... G03G 9/083; G03G 9/087
(52) U.S. Cl. ..... 430/109.4; 430/108.1; 430/111.4
(58) Field of Search ..... 430/110, 111, 430/109, 106.6, 106.1, 106.2, 109.4, 108.1, 111.4

(56) References Cited

U.S. PATENT DOCUMENTS

| | | | | |
|---|---|---|---|---|
| 2,297,691 A | | 10/1942 | Carlson | 430/55 |
| 3,590,000 A | | 6/1971 | Palermiti et al. | 430/110 |
| 3,666,363 A | | 5/1972 | Tanaka et al. | 355/17 |
| 3,983,045 A | | 9/1976 | Jugle et al. | 430/110 |
| 4,071,361 A | | 1/1978 | Marushima | 430/54 |
| 4,859,550 A | | 8/1989 | Gruber et al. | 430/110 |
| 4,883,736 A | | 11/1989 | Hoffend et al. | 430/110 |
| 4,891,293 A | | 1/1990 | Sacripante et al. | 430/109 |
| 4,971,882 A | | 11/1990 | Jugle | 430/110 |
| 5,047,305 A | * | 9/1991 | Uchida et al. | 430/110 |
| 5,080,995 A | | 1/1992 | Fox et al. | 430/137 |
| 5,116,713 A | | 5/1992 | Uchida et al. | 430/110 |
| 5,124,217 A | | 6/1992 | Gruber et al. | 430/122 |
| 5,176,978 A | | 1/1993 | Kumashiro et al. | |
| 5,194,357 A | | 3/1993 | Hodgson | 430/110 |
| 5,212,037 A | | 5/1993 | Julien et al. | 430/110 |
| 5,227,460 A | | 7/1993 | Mahabadi et al. | 528/272 |
| 5,244,764 A | | 9/1993 | Uno et al. | 430/106 |
| 5,330,871 A | | 7/1994 | Tanikawa et al. | 430/110 |
| 5,346,792 A | | 9/1994 | Kobayashi et al. | 430/109 |
| 5,368,970 A | | 11/1994 | Grushkin | 430/110 |
| 5,439,770 A | * | 8/1995 | Taya et al. | 430/106.6 |
| 5,503,954 A | * | 4/1996 | Maruta et al. | 430/110 |
| 5,578,409 A | * | 11/1996 | Kotaki et al. | 430/110 |
| 6,077,638 A | * | 6/2000 | Tanikawa et al. | 430/106.2 |

FOREIGN PATENT DOCUMENTS

| | | | |
|---|---|---|---|
| EP | 0488360 | | 6/1992 |
| EP | 0519715 | | 12/1992 |
| EP | 606873 | A1 * | 7/1994 |
| EP | 621513 | A2 * | 10/1994 |
| JP | 59-12963 | | 1/1984 |
| JP | 59-129863 | | 7/1984 |
| JP | 3-50561 | | 3/1991 |
| JP | 4-97162 | | 3/1992 |
| JP | 4-204543 | | 7/1992 |

OTHER PUBLICATIONS

Patent Abstracts of Japan, vol. 12, No. 48 (P–666) [2895], Feb. 1988 of JP 62–195276.
Derwent Abstract No. AN 91–257358 of JP 3–168651 dated 1991.

* cited by examiner

*Primary Examiner*—Janis L. Dote
(74) *Attorney, Agent, or Firm*—Fitzpatrick, Cella, Harper & Scinto

(57) ABSTRACT

A toner for developing an electrostatic image is constituted by a binder resin and a long-chain compound. The binder resin is a polyester resin or vinyl resin respectively having an acid value of preferably 25–70 mgKOH/g. The long-chain compound is a long-chain alkyl alcohol having an OH value of 10–120 mgKOH/g or a long-chain alkyl carboxylic acid having an acid value of 5–120 mgKOH/g and is contained so as to satisfy a condition of the following formula (1) or formula (2):
Formula (1)

acid value of binder resin +OH value of long-chain alkyl alcohol >(¼)×OH value of binder resin, or
Formula (2)

acid value of binder resin +acid value of long-chain alkyl carboxylic acid >(¼)×OH value of binder resin. The toner is characterized by a good balance between fixing performances and developing performances suitable for a variety of models of image forming apparatus and in wide ranges of environmental conditions.

10 Claims, 3 Drawing Sheets

TONER FOR DEVELOPING ELECTROSTATIC IMAGE

This application is a continuation of prior application Ser. No. 08/361,526 filed Dec. 22, 1994, now abandoned.

FIELD OF THE INVENTION AND RELATED ART

The present invention relates to a toner for developing electrostatic images used in image forming methods, such as electrophotography, electrostatic recording or electrostatic printing, particularly a toner suitable for hot roller fixation.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy or print carrying a fixed toner image.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation.

It is however a current state that different toners are used for different models of copying machines and printers. This is primarily because the different models adopt different fixing speeds and fixing temperatures. More specifically, in the fixing step, a hot roller surface and a toner image contact each other in a melted state and under a pressure, so that a part of the toner is transferred and attached to the fixing roller surface and then re-transferred to a subsequent fixation sheet to soil the fixation sheet. This is called an offset phenomenon and is remarkably affected by the fixing speed and temperature. Generally, the fixing roller surface temperature is set to be low in case of a slow fixing speed and set to be high in case of a fast fixing speed. This is because a constant heat quantity is supplied to the toner image for fixation thereof regardless of a difference in fixing speed.

However, the toner on a fixation sheet is deposited in several layers, so that there is liable to occur a large temperature difference between a toner layer contacting the heating roller and a lowermost toner layer particularly in a hot-fixation system using a high heating roller temperature. As a result, a topmost toner layer is liable to cause an offset phenomenon in case of a high heating roller temperature, while a low-temperature offset is liable to occur because of insufficient melting of the lowermost toner layer in case of a low heating roller temperature.

In order to solve the above problem, it has been generally practiced to increase the fixing pressure in case of a fast fixing speed in order to promote the anchoring of the toner onto the fixation sheet. According to this method, the heating roller temperature can be somewhat lowered and it is possible to obviate a high-temperature offset phenomenon of an uppermost toner layer. However, as a very high shearing force is applied to the toner layer, there are liable to be caused several difficulties, such as a winding offset that the fixation sheet winds about the fixing roller, the appearance of a trace in the fixed image of a separating member for separating the fixation sheet from the fixing roller, and inferior copied images, such as resolution failure of line images and toner scattering, due to a high pressure.

Accordingly, in a high-speed fixing system, a toner having a lower melt viscosity is generally used than in the case of low speed fixation, so as to lower the heating roller temperature and fixing pressure, thereby effecting the fixation while obviating the high-temperature offset and winding offset. However, in the case of using such a toner having a low melt viscosity in low speed fixation, an offset phenomenon is liable to be caused because of the low viscosity.

Accordingly, there has been desired a toner which shows a wide fixable temperature range and an excellent anti-offset characteristic and is applicable from a low speed apparatus to a high speed apparatus.

On the other hand, in recent years, there have been also desired high-quality copy or print images in accordance with the use of digitalized copying machines and fine toner particles.

More specifically, it has been desired to obtain a photographic image accompanied with characters, so that the character images are clear while the photographic image is excellent in density gradation faithful to the original. Generally, in a copy of a photographic image accompanied with characters, if the line density is increased so as to provide clear character images, not only the density gradation characteristic of the photograph image is impaired, but also the halftone part thereof are roughened.

Further, resolution failure (collapsion) of line images and scattering are liable to be caused at the time of fixation as described above, so that the image qualities of the resultant copy images are rather liable to be deteriorated.

Further, in case where the line image density is increased, because of an increased toner coverage, a thick toner image is pushed against a photosensitive member to be attached to the photosensitive member in the toner transfer step, so that a so-called transfer failure (or a hollow image), i.e., a partial lack toner image (line images in this case), in the transferred image, is liable to be caused, thereby providing poor quality of copy images. On the other hand, in case where the gradation characteristic of a photographic image is intended to be improved, the density of characters or line images are liable to be lowered, thus providing unclear images.

In recent years, there has been obtained some improvement in density gradation characteristic by a system including image density readout and digital conversion. However, a further improvement has been desired.

Regarding density gradation characteristic, it is impossible to obtain a linear relationship between a developing potential (difference between a photosensitive member potential and a developer-carrying member potential) and a resultant (copy) image density. More specifically, as shown in FIG. 1, a characteristic curve (e.g., a solid curve representing a case of providing a maximum intensity of 1.4) becomes downwardly convex at a low developing potential and upwardly convex at a high developing potential. Accordingly, in a halftone region, a slight change in developing potential leads to a remarkable change in image density. This provides a complexity in obtaining a satisfactory density gradation characteristic.

Generally, copied images appear clearer because of an edge effect so that clear line images can be retained in case where a maximum density of ca. 1.30 is attained at a solid image part which is less affected by the edge effect.

In case of a photographic image, however, the maximum density of a photograph appears less at a glance because of its surface gloss but actually amounts to a very high level of 1.90–2.00. Accordingly, in a copy of a photographic image, even if the surface gloss is suppressed, a solid part image density of ca. 1.4–1.5 is required since a density increase due to the edge effect cannot be excepted because of a large image area.

Accordingly, in providing a copy of a photographic image accompanied with characters, it becomes very important to obtain a developing potential-image density relationship which is close to the first order (linear) one and also a maximum image density of 1.4–1.5.

Further, the density gradation characteristic is liable to be remarkably affected by the saturation charge and the charging speed of a developer used. In case where the saturation charge is appropriate for the developing conditions, a developer showing a slow charging speed provides a low maximum image density, thus generally thin and blurred images in the initial stage of copying. In this case, however, non-problematic images can be obtained if the maximum image density is ca. 1.3, as described above, thus being able to obviate an adverse effect of the slow chargeability. Even in case of the slow charging speed, the initial copy image density is increased if the saturation charge is increased. However, on continuation of copying, the charge of the developer is gradually increased to finally exceed an appropriate charge for development, thereby resulting in a lower copy image density. Also in this case, no problem occurs in line images if the maximum image density is ca. 1.3.

From the above, it is understood that a photographic image is more remarkably affected by the saturation charge and the charging speed of a developer than a line image.

The use of a smaller particle size toner can increase the resolution and clearness of an image but is also liable to be accompanied with various difficulties.

First, a smaller particle size toner is liable to impair the fixability of a halftone image. This is particularly noticeable in high-speed fixation. This is because the toner coverage in a halftone part is little and a portion of toner transferred to a concavity of a fixation sheet receives only a small quantity of heat and the pressure applied thereto is also suppressed because of the convexity of the fixation sheet. A portion of toner transferred onto the convexity of the fixation sheet in a halftone part receives a much larger shearing force per toner particle because of a small toner layer thickness compared with that in a solid image part, thus being liable to cause offset or result in copy images of a lower image quality.

Fog is another problem. If the toner particle size is reduced, the surface area of a unit weight of toner is increased, so that the charge distribution thereof is liable to be broadened to cause fog. As the toner surface area is increased per unit weight thereof, the toner chargeability is liable to be affected by a change in environmental conditions.

If the toner particle size is reduced, the dispersion state of a polar material and a colorant is liable to affect the toner chargeability.

When such a small particle size toner is applied to a high-speed copying machine, the toner is liable to be excessively charged to cause fog and a density decrease, particularly in a low-humidity environment.

Further, in connection with a trend of providing a copying machine with a multiplicity of functions, such as a superposed multi-color copying of erasing a part of an image as by exposure and inserting another image into the erased part, or frame erasure of erasing a frame part on a copying sheet, fog of a small particle size is liable to remain in such a part to be erased into white.

When an image is erased by providing a potential of a polarity opposite to that of a latent image potential with respect to a development reference potential as by irradiation with intense light from LED, a fuse lamp, etc., the erased part is liable to cause fog.

Japanese Laid-Open Patent Application (JP-A) 59-129863 and JP-A 3-50561 have proposed the use of a polyester resin and an acid-modified polyolefin. According to the proposal, maleic anhydride is added to polyolefin synthesized in advance. In case where an acid anhydride is added, the polarity obtained thereby is very weak, so that it is impossible to break an association of polymer OH groups. Accordingly, in an initial stage of copying, the charging speed is fast to provide a high charge because of associations of polymer carboxylic groups. In this instance, the toner quantity used for development is large to provide high image density copies. However, as many associations of polymer OH groups are present, the saturation charge is gradually reduced so that the copy image density is gradually lowered correspondingly.

Maleic anhydride used in the above proposals react with water to open its ring but, even in such a case, the associatability the resultant carboxylic group is lowered because of an adjacent carboxylic group. Further, maleic acid is not always attached to molecular chain terminals. Accordingly, when maleic acid is attached to a middle of a molecular chain, this is identical to branching of the molecule chain. Further, according to the proposed method utilizing a post addition reaction, it is very difficult to add one maleic acid to each molecular chain. Accordingly, plural carboxyl groups may be introduced into one molecule chain, thereby resulting in a lower associatability. In this case, the charging speed and the environmental stability are liable to be lowered.

U.S. Pat. No. 4,883,736, JP-A 4-97162 and JP-A 4-204543 disclose methods of using aliphatic alcohols. In these methods, however, no carboxylic group association is formed, so that the resultant charging speed is slow, whereby the density gradation characteristic of copy images is not stabilized in a digital copying machine.

SUMMARY OF THE INVENTION

A generic object of the present invention is to provide a toner for developing electrostatic images having solved the above-mentioned problems.

A more specific object of the present invention is to provide a toner for developing electrostatic images showing an excellent anti-offset characteristic without impairing the fixability from a low fixing speed to a high fixing speed.

Another object of the present invention is to provide a toner for developing electrostatic images, even in a small particle size, capable of showing a good fixability at a halftone part and providing copy images of good image quality from low to high process speed and fixing speed.

Another object of the present invention is to provide a tone for developing electrostatic images capable of providing high-density copy images free from fog from a low to a high process speed.

Another object of the present invention is to provide a toner for developing electrostatic images capable of providing good images in a low-humidity environment and also in a high-humidity environment without being affected by a change in environmental conditions.

Another object of the present invention is to provide a toner for developing electrostatic images applicable to wide variety of models of image forming apparatus.

Another object of the present invention is to provide a toner for developing electrostatic images having excellent durability and capable of providing copy images having a high image density and free from fog even in a long period of continuous image formation on a larger number of sheets.

Another object of the present invention is to provide copies of a photographic image with characters including clear character images and photographic images having a density gradation characteristic faithful to the original.

According to the present invention, there is provided a toner for developing an electrostatic image, comprising: a binder resin and a long-chain compound, wherein the binder resin comprises a polyester resin having an acid value, and the long-chain compound comprises a long-chain alkyl alcohol having an OH value of 10–120 mgKOH/g or a long-chain alkyl carboxylic acid having an acid value of 5–120 mgKOH/g and is contained so as to satisfy a condition of the following formula (1) or formula (2):

Formula (1)

acid value of binder resin +OH value of long-chain alkyl alcohol >(¼)×OH value of binder resin, or Formula (2)

acid value of binder resin +acid value of long-chain alkyl carboxylic acid >(¼)×OH value of binder resin.

According to another aspect of the present invention, there is provided a toner for developing an electrostatic image, comprising: a binder resin and a long-chain compound, wherein the binder resin comprises a vinyl resin having an acid value of 2.5–70 mgKOH/g, and the long-chain compound comprises a long-chain-alkyl alcohol having an OH value of 10–120 mgKOH/g or a long-chain alkyl carboxylic acid having an acid value of 5–120 mgKOH/g and is contained so as to satisfy a condition of the following formula (1) or formula (2):

Formula (1)

acid value of binder resin +OH value of long-chain alkyl alcohol >(¼)×OH value of binder resin, or Formula (2)

acid value of binder resin +acid value of long-chain alkyl carboxylic acid >(¼)×OH value of binder resin.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
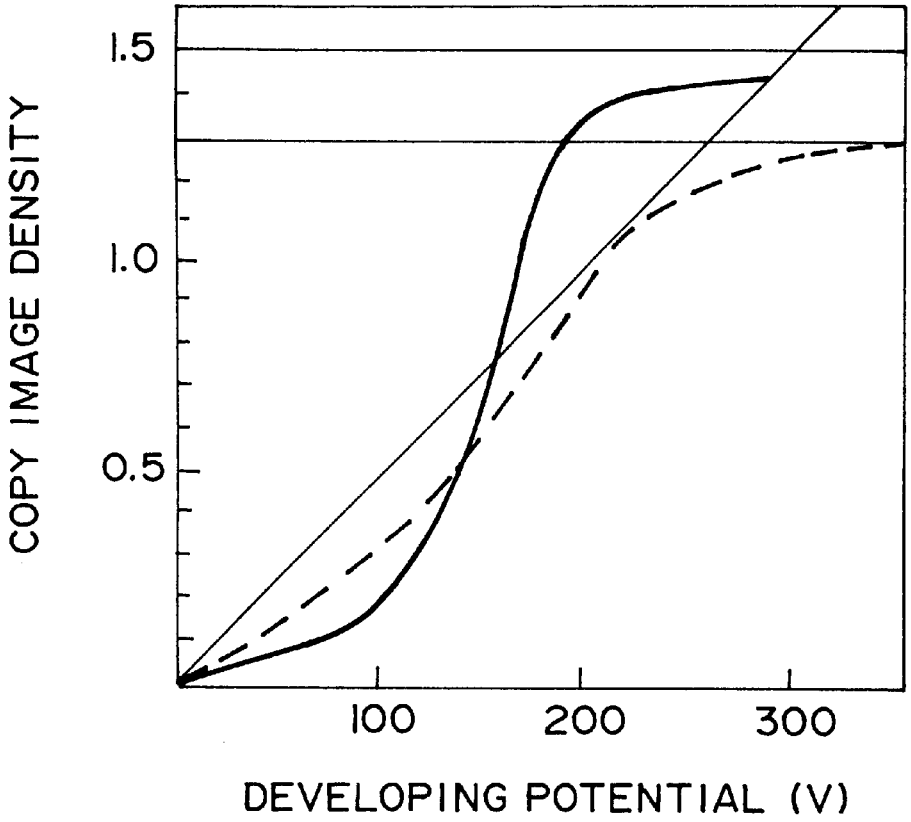
FIG. 1 is a graph showing a relationship between a developing potential and a fixed toner image density, including a solid line representing a case where a maximum is set to be 1.4 or larger and a dashed line representing a case where a better density gradation characteristic is intended.

According to our detailed study, regarding the toner charging characteristics, it has been known that a carboxyl group has a function of providing an increased charging speed and an OH group has a function of providing a lower saturation charge. This is considered to be based on the following mechanism.

A carboxyl group is a functional group having a very strong polarity so that carboxyl groups can associate with each other to provide a state where polymer chains extend outwardly from the side of association. In case of two carboxyl groups, for example, the state of association may be represented as follows:

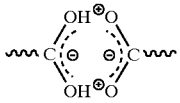

and the structure is considered to be stable and exhibit a strong orientation.

In view of the bond angle of a carbonyl group (O ——— C ——— O), four or more carboxyl groups are considered to form an assembly of associations. The thus formed assembly of carboxyl group associations is like a hole and therefore can easily accept a free electron. This is assumed to be a reason of accelerated charging speed. The association state is resistant to an external attack and particularly water cannot easily coordinate therewith. Accordingly, the environmental stability of the toner is retained good.

In case of OH groups, in contrast with carboxyl groups, associated two OH groups for example assume a state as follows:

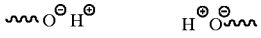

and accordingly the polarity is rather enhanced than in the case of a single OH group. The localized charge is not directed inwardly so that the state is susceptible of external attack. It is accordingly assumed that water can easily coordinate therewith.

Base on the above recognition, we have discovered a method of providing an increased charging speed and stabilizing an appropriate level of saturation charge.

The method includes the use of a long-chain alkyl carboxylic acid and/or a long-chain alkyl alcohol as described above.

A long-chain alkyl carboxylic acid forms an association by itself. Accordingly, a long-chain alkyl carboxylic acid forms an association of carboxyl groups to contribute to an increase in toner charging speed. An OH group is susceptible of an external attack as described above, so that a —COOH group in a long-chain alkyl carboxylic acid has a function of collapsing an association of OH groups in a polymer. However, a—COOH group of a long-chain alkyl carboxylic acid in a polymer matrix affects an environment surrounding a COOH association to rather increase the toner charging speed.

A long-chain alkyl alcohol also affects an environment surrounding a COOH association in a polymer matrix to increase the toner charging velocity similarly as the long-chain alkyl carboxylic acid. A long-chain alkyl alcohol also affects OH groups in a polymer matrix, thereby functioning to reduce the localization of charge density as a whole. Accordingly, the resin is less susceptible of an external attack, particularly with water, thereby increasing the saturation charge of the toner.

A carboxylic acid having a branched structure instead of a long-chain alkyl group causes a steric hindrance because of the branching, thereby lowering the associatability. The associatability of carboxylic groups is also lowered in case where plural carboxylic groups are present in one molecular chain. As the associatability is lowered, the resultant toner is provided with a lower charging speed and an inferior environmental stability. In case of an alcohol having a branched structure instead of a long-chain alkyl group, the alcohol causes a steric hindrance because of the branching, so that it does not act on an OH group of the polymer, so that the resin is liable to be affected by moisture, thereby lowering the saturation change. In case of plural OH groups in one molecular chain, the resin is also liable to be affected.

The presence of a carboxylic group association improves the dispersion of the long-chain alkyl alcohol and/or long-chain alkyl carboxylic acid. Accordingly, the presence of a carboxylic group association in the polymer and the presence of a long-chain alkyl alcohol and/or long-chain alkyl carboxylic acid affecting the environment surrounding the association are important for the increase in charging speed and environmental stability.

Further, it has been also known that the presence of a carboxyl group association in the polymer and the presence of the long-chain alkyl alcohol and/or long-chain alkyl carboxylic acid remarkably increase the dispersibility of a charge control agent. Accordingly, it has become possible re-utilize a fine powder fraction by-produced in the conventional toner production step as a material for toner production.

In order to increase the charging speed of toner particles, it is important that a carboxylic group is present in the main binder resin. The above-mentioned formula (1) provides a condition for suppressing the action of OH groups in the polymer. The factor of ¼allotted to the OH value reflects the weak dissociation of OH groups. In other words, as the localization of electron density is little, all the OH groups do not associate each other. Accordingly, a better condition for the formula (1) or (2) regarding the toner chargeability is given as (the left side)—(the right side) >5, more preferably (the left side)—(the right side) >10, for the formula (1) or (2).

In case where the long-chain alkyl alcohol and long-chain alkyl carboxylic acid are used in combination, the left sides of the formulae (1) and (2) can be added.

A further better condition for accomplishing the object of the present invention, particularly for providing an increased charging speed, is given by the following formula $(1)_f$ or/and $(2)_f$ which also takes into account the content factor of each component in the formula (1) or/and (2):

Formula $(1)_f$:

fr×(acid value of binder resin)+fa×(OH value of long-chain alkyl alcohol)>(¼)×fr (OH value of binder resin), or Formula $(2)_f$:

fr×(acid value of binder resin)+fc× (acid value of long-chain alkyl carboxylic acid) >(¼) x fr x (OH value of binder resin), wherein fr, fa and fc denote a content factor of the binder resin, long-chain alkyl alcohol and long-chain alkyl carboxylic acid, respectively.

A further better toner chargeability is given if (the left side)—(the right-side)>5, more preferably (the left side)—(the right side)>10, for the formula $(1)_f$ or/and $(2)_f$.

In case where the long-chain alkyl alcohol and long-chain alkyl carboxylic acid are used in combination, the left sides of the formulae $(1)_f$ and $(2)_f$ can be added.

A further preferred condition for accomplishing the object of the present invention is given when the left side in the formula $(1)_f$ or/and $(2)_f$ is 5–90 in the case of a polyester resin being the principal binder resin and 5–50 in the case of a vinyl resin being the principal binder resin.

This is because, if the left side is smaller than 5, the amount of the carboxyl group or OH group having a function of increasing the charging velocity as described above is decreased, so that the toner charging speed is liable to be lowered, thereby resulting a lower image density at the initial stage.

If the left side is larger than 90, the resultant toner is liable to be affected by an environmental change, particularly moisture, thus resulting in an inferior environmental stability. In the case of a vinyl resin, the carboxyl group is more present as side groups rather than terminal group. Accordingly, if the left side is larger than 50, the resin frequently fails to form association, thus being liable to be affected by an environment change.

The polyester resin preferably used in the present invention may have a composition as described below.

The polyester resin used in the present invention may preferably comprise 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

(A)

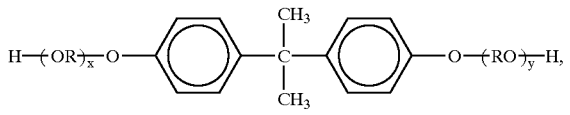

wherein R denotes an ethylene or propylene group, x and y are independently 0 or a positive integer with the proviso that the average of x+y is in the range of 0–10; diols represented by the following formula (B):

(B)

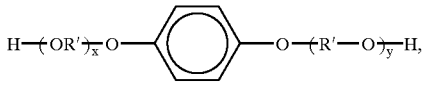

wherein R' denotes —$CH_2CH_2$—,

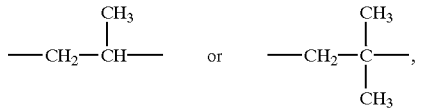

x' and y' are independently 0 or a positive integer with the proviso that the average of x'+y' is in the range of 0–10.

Examples of the dibasic acid constituting at least 50 mol. % of the total acid may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$ –$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

Examples of polyhydric alcohols may include: glycerin, pentaerythritol, sorbitol, sorbitan, and oxyalkylene ethers of novolak-type phenolic resin. Examples of polybasic carboxylic acids having three or more functional groups may include: trimellitic acid, pyromellitic acid, benzophenonetetracarboxylic acid, and their anhydrides.

An especially preferred class of alcohol components constituting the polyester resin is a bisphenol derivative represented by the above formula (A), and preferred examples of acid components may include dicarboxylic acids inclusive of phthalic acid, terephthalic acid, isophthalic acid and their anhydrides; succinic acid, n-dodecenylsuccinic acid, and their anhydrides, fumaric acid, maleic acid, and maleic anhydride. Preferred examples of crosslinking components may include trimellitic anhydride, benzophenonetetracarboxylic acid, pentaerythritol, and oxyalkylene ether of novolak-type phenolic resin.

The polyester resin may preferably have a glass transition temperature of 40–90° C., particularly 45–85° C., a number-average molecular weight (Mn) of 1,000–50,000, more preferably 1,500–20,000, particularly 2,500–10,000, and a weight-average molecular weight (Mw) of $3\times10^3$–$3\times10^6$, more preferably $1\times10^4$–$2.5\times10^6$, further preferably $4.0\times10^4$–$2.0\times10^6$.

The polyester resin may preferably have an acid value of 2.5–80 mgKOH/g, more preferably 5–60 mgKOH/g, further preferably 10 –50 mgKOH/g, and an OH value of at most 80, more preferably at most 70, further preferably at most 60.

If the polyester resin has an acid value of below 2.5, few carboxylic group association assemblies of the binder resin are formed, thus being liable to result in a slow charging speed. If the polyester resin has an acid value exceeding 80, there remain many carboxyl groups not forming association assemblies in the polyester resin, thus being susceptible of attack with moisture and resulting in an inferior environmental stability. If the polyester resin has an OH value exceeding 80, many associates of OH groups are formed so that the polyester resin is susceptible of attack with moisture to result in a lower environmental stability.

In the present invention, it is possible to use two or more species of polyester resins having different compositions, molecular weights, acid values and/or OH values to form a binder resin.

Examples of a vinyl monomer to be used for providing the vinyl resin having an acid value may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinyl-naphthalenes; acrylic acid derivatives or methacrylic acid derivatives, such as acrylonitrile, methacryro-nitrile, and acrylamide; esters of the below-mentioned α,β-unsaturated acids and diesters of the below-mentioned dibasic acids.

Examples of an acid value-providing or carboxy group-containing monomer may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; unsaturated dibasic acid half esters, such as mono-methyl maleate, mono-ethyl maleate, mono-butyl maleate, mono-methyl citraconate, mono-ethyl citraconate, mono-butyl citraconate, mono-methyl itaconate, mono-methyl alkenylsuccinate, monomethyl fumarate, and mono-methyl mesaconate; unsaturated dibasic acid esters, such as dimethyl maleate and dimethyl fumarate; α,β-unsaturated acids, such as acrylic acid, methacrylic acid, crotonic acid, and cinnamic acid; α,β-unsaturated acid anhydrides, such as crotonic anhydride, and cinnamic anhydride; anhydrides between such an α,β-unsaturated acid and a lower aliphatic acid; alkenylmalonic acid, alkenylglutaric acid, alkenyladipic acid, and anhydrides and monoesters of these acids.

It is also possible to use a hydroxyl group-containing monomer: inclusive of acrylic or methacrylic acid esters, such as 2-hydroxyethyl acrylate, and 2-hydroxyethyl methacrylate; 4-(1-hydroxy-1-methylbutyl)styrene, and 4-(1-hydroxy-1-methylhexyl)styrene.

The vinyl resin may have an acid value of 2.5–70 mgKOH/g, preferably 5 –60 mgKOH/g, more preferably 10 –50 mgKOH/g, and an OH value of at most 40, preferably at most 30, more preferably at most 20. If the vinyl resin has an acid value below 2.5, few carboxylic group association assemblies of the binder resin are formed, thus being liable to result in a slow charging speed. If the vinyl resin has an acid value exceeding 70, there remain many carboxyl groups not forming association assemblies in the vinyl resin, thus being susceptible of attack with moisture and resulting in an inferior environmental stability. If the vinyl resin has an OH value exceeding 40, many associates of OH groups are formed so that the vinyl resin is susceptible of attack with moisture to result in a lower environmental stability.

The vinyl resin may have a glass transition point of 45 –80° C., preferably 55 –70° C., a number-average molecular weight (Mn) of $2.5\times10^3$–$5\times10^4$, preferably $3\times10^3$–$2\times10^4$, and a weight-average molecular weight (Mw) of $1\times10^4$–$1.5\times10^6$, preferably $2.5\times10^4$–$1.25\times10^6$.

It is preferred that the toner binder resin has a molecular weight distribution measured by gel permeation chromatography of a soluble content thereof (i.e., a filtrate of a solution thereof in a solvent, such as tetrahydrofuran (THF)) such that it provides peaks at least in a molecular weight region of $2\times10^3$–$4\times10^4$, preferably $3\times10^3$–$3\times10^4$, more preferably $3.5\times10^3$–$2\times10^4$, and in a molecular weight region of $5\times10^4$–$1.2\times10^6$, preferably $8\times10^4$–$1.1\times10^6$, more preferably $1.0\times10^5$–$1.0\times10^6$.

As another preferred mode, the binder resin may preferably provide a molecular weight distribution such that a molecular weight region of at most $4.5\times10^4$ and a region of a larger molecular weight provide an areal ratio of 1:9–9.5:0.5, preferably 2:8–9:1, further preferably 3:7–8.5:1.5.

Regarding the molecular weight distribution, it is also preferred that the binder resin includes a resin component in a molecular weight region of at most $4.5\times10^4$ showing an acid value of 3–80 mgKOH/g, preferably 5 –70 mgKOH/g, more preferably 10 –60 mgKOH/g, and a resin component in a molecular weight of larger than $4.5\times10^4$ showing an acid value of 0–60 mgKOH/g, preferably 0–50 mgKOH/g, more preferably 0–40 mgKOH/g.

The above condition is preferred because carboxylic groups chemically bonded to a lower molecular weight component more readily form association assemblies. Further, because of the presence of a higher molecular weight component, the dispersion of the long-chain alkyl alcohol and/or long-chain alkyl carboxylic acid is improved, so that the resultant toner particles are provided with an excellent chargeability. However, if the peak molecular weight of the high molecular weight component exceeds $1.2\times10^6$, the dispersion of the long-chain alkyl alcohol or long-chain alkyl carboxylic acid becomes rather difficult because of too strong entanglement of polymer chains, thus resulting in a lower chargeability.

In the present invention, it is also possible to add another type of resin, such as polyurethane, epoxy resin, polyvinyl butyral, modified rosin, terpene resin, phenolic resin, aliphatic or alicyclic hydrocarbon resin, or aromatic petroleum resin, as desired, to the binder resin.

A preferred class of the long-chain alkyl alcohol used in the present invention may be represented by the following formula (3):

Formula (3):

$$CH_3(CH_2)\times CH_2OH \ (x=35–250).$$

The long-chain alkyl alcohol may for example be produced as follows. Ethylene is polymerized in the presence of a Ziegler catalyst and, after the polymerization, oxidized to provide an alkoxide of the catalyst metal and polyethylene, which is then hydrolyzed to provide an objective long-chain alkyl alcohol. The thus prepared long-chain alkyl alcohol has little branching and a sharp molecular weight distribution and is suitably used in the present invention.

A preferred class of the long-chain alkyl carboxylic acid used in the present invention may be represented by the following formula (4):

Formula (4):

$$CH_3(CH_2)_yCH_2COOH \ (y=35–250)$$

The long-chain alkyl carboxylic acid may be produced by oxidizing the long-chain alkyl alcohol of the formula (3).

The parameters x and y in the formulae (3) and (4) correspond to the average polymerization degree of ethylene. The parameters x and y on an average may be 35–250, preferably 35–200. If the average of parameter x or y is below 35, the resultant toner is liable to cause a melt sticking onto the photosensitive member surface and show a lower storage stability. In case where the parameter x or y exceeds 250, the above-mentioned effect contributing to the toner chargeability is little.

It is further preferred that the long-chain alkyl alcohol contains at least 50 wt. % of a long-chain alkyl alcohol component having at least 37 carbon atoms based on the total alkyl alcohol components. On the other hand, it is preferred that. the long-chain alkyl carboxylic acid contains at least 50 wt. % of a long-chain alkyl carboxylic acid component having at least 38 carbon atoms based on the total alkyl carboxylic acid components. Unless these conditions are satisfied, the resultant toner is liable to cause a melt-sticking onto the photosensitive member surface and exhibit a lower storage stability.

The long-chain alkyl alcohol or long-chain alkyl carboxylic acid used in the present invention may preferably have a melting point of at least 91° C. If the melting point is below 91° C., the long-chain alkyl alcohol or long-chain alkyl carboxylic acid is liable to be separated by melting during the melt-kneading step for toner production, and show an inferior dispersibility in toner particles. The resultant toner is liable to cause a melt-sticking onto the photosensitive member surface and show a lower storage stability. Further, because of a difference in flowability among toner particles, the toner is liable to have ununiform chargeability, cause fog and provide rough images.

The long-chain alkyl alcohol or long-chain alkyl carboxylic acid may preferably have a weight-average molecular weight (Mw) of 500–10,000, more preferably 600 –8,000, and a Mw/Mn of at most 3, more preferably at most 2.5, so as to suppress the toner melt-sticking onto the photosensitive member and provide an improved storage stability of the toner.

The long-chain alkyl alcohol used in the present invention may preferably have an OH value of 5–150 mgKOH/g, more preferably 10–120 mgKOH/g, further preferably 20–100 mgKOH/g. If the long-chain alkyl alcohol has an OH value below 5 mgKOH/g, the effect thereof on the carboxyl group and OH group of the binder resin, and the dispersibility thereof in the binder resin is lowered to result in ununiform toner chargeability leading to a density decrease, fog, and inferior image quality in copy images. In case where the long-chain alkyl alcohol has an OH value exceeding 150 mgKOH/g, the localization of the OH group charge density is increased to exceed the charge density localization of the OH groups in the binder resin, thus lowering the above-mentioned effect of alleviating the charge density localization of the OH groups in the binder resin. As a result, copy images in the initial state of image formation are liable to have a low density and a poor image quality. Alternatively, even if the initial density is high, the density is liable to be lowered gradually on continuation of copying. Further, in case where the OH value exceeds 150 mgKOH/g, the long-chain alkyl alcohol is caused to contain a large amount of low-molecular weight molecules so that the resultant toner is liable to cause a melt-sticking onto the photosensitive member and lower the storage stability.

The long-chain alkyl carboxylic acid used in the present invention may preferably have an acid value of 2–150 mgKOH/g, more preferably 5–120 mgKOH/g, further preferably 10–100 mgKOH/g. If the long-chain alkyl carboxylic acid has an acid value below 5 mgKOH/g, the effect thereof onto the OH groups in the binder resin becomes small and the dispersion thereof in the binder resin is also worse, thereby resulting in inferior image qualities of copy images, similarly as in the case of the long-chain alkyl alcohol. Further, as the carboxyl groups do not sufficiently associate each other, the environmental characteristic is liable to be impaired. Further, the resultant toner is liable to show a low charging velocity, to result in a lower density at the initial stage of copying. In case where the acid value of the long-chain alkyl carboxylic acid exceeds 150 mgKOH/g, it contains a large amount of low-molecular weight molecules, the resultant toner is liable to cause melt-sticking onto the photosensitive member and lower the storage stability, similarly as in the case of the long-chain alkyl alcohol.

The long-chain alkyl alcohol and/or the long-chain alkyl carboxylic acid may preferably be contained in an amount of 0.1–30 wt. parts, particularly 0.5–20 wt. parts, per 100 wt. parts of the binder resin. Below 0.1 wt. part, the above-mentioned effect cannot be exhibited sufficiently. Above 30 wt. parts, the pulverizability in toner production becomes inferior.

In the toner for developing electrostatic images according to the present invention, it is possible to add a charge control agent, as desired, in order to further stabilize the chargeability thereof. The charge control agent may be used in 0.1–10 wt. parts, preferably 0.1–5 wt. parts, per 100 wt. parts of the binder resin.

Examples of the charge control agents known in the art may include organometal complexes and chelate compounds, inclusive of mono-azo metal complexes, aromatic hydroxycarboxylic acid metal complexes and aromatic dicarboxylic acid metal complexes. Other examples may include: aromatic hydroxycarboxylic acids, aromatic mono- and poly-carboxylic acids, metal salts, anhydrides and esters of these acids, and phenol derivatives of bisphenols.

When the toner according to the present invention is constituted as a magnetic toner, the magnetic toner may contain a magnetic material, examples of which may include: iron oxides, such as magnetite, hematite, and ferrite; iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}Ol_9$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size (Dav.) of 0.1 –2 pm, preferably 0.1–0.3 pm. The magnetic material may preferably show magnetic properties when measured by application of 10 kilo-Oersted, inclusive of: a coercive force (Hc) of 20–150 Oersted, a saturation magnetization ($\sigma s$) of 50–200 emu/g, particularly 50–100 emu/g, and a residual magnetization ($\sigma r$) of 2–20 emu/g.

The magnetic material may be contained in the toner in a proportion of 10–200 wt. parts, preferably 20–150 wt. parts, per 100 wt. parts of the binder resin.

The toner according to the present invention may optionally contain a non-magnetic colorant, examples of which may include: carbon black, titanium white, and other pigments and/or dyes. For example, the toner according to the present invention, when used as a color toner, may contain a dye, examples of which may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6. Examples of the pigment may include: Chrome Yellow, Cadmium Yellow, Mineral Fast Yellow, Navel Yellow, Naphthol Yellow S, HANSA Yellow G, Permanent Yellow NCG, Tartrazine Lake, Orange Chrome Yellow, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B; Manganese Violet, Fast Violet B, Methyl Violet Lake, Ultramarine, Cobalt BLue, Alkali Blue Lake, Victoria Blue Lake, Phthalocyanine Blue, Fast Sky Blue, Indanthrene Blue BC, Chrome Green, chromium oxide, Pigment Green B, Malachite Green Lake, and Final Yellow Green G.

Examples of the magenta pigment may include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

The pigments may be used alone but can also be used in combination with a dye so as to increase the clarity for providing a color toner for full color image formation. Examples of the magenta dyes may include: oil-soluble dyes, such as C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; and basic dyes, such as C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28.

Other pigments include cyan pigments, such as C.I. Pigment Blue 2, 3, 15, 16, 17; C.I. Vat Blue 6, C.I. Acid Blue 45, and copper phthalocyanine pigments represented by the following formula and having a, phthalocyanine skeleton to which 1–5 phthalimidomethyl groups are added:

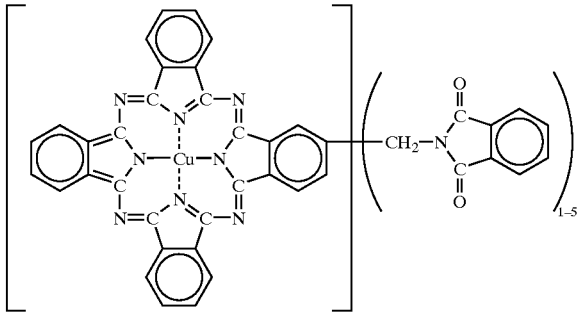

Examples of yellow pigment may include: C.I. Pigment Yellow 1, 2, 3, 4, 5, 6, 7, 10, 11, 12, 13, 14, 15, 16, 17, 23, 65, 73, 83; C.I. Vat Yellow 1, 13, 20.

Such a non-magnetic colorant may be added in an amount of 0.1–60 wt. parts, preferably 0.5–50 wt. parts, per 100 wt. parts of the binder resin.

In the present invention, it is also possible to incorporate one or two or more species of release agent, as desired within, toner particles.

Examples of the release agent may include: aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, behenyl alcohol, ceryl alcohol, and melissyl alcohol; polyhydric alcohols, such as sorbitol; aliphatic acid amides, such as linoleylamide, oleylamide, and laurylamide; saturated aliphatic acid bisamides, methylene-bisstearylamide, ethylene-biscaprylamide, and ethylene-biscaprylamide; unsaturated aliphatic acid amides, such as ethylene-bisolerylamide, hexamethylene-bisoleylamide, N,N'-dioleyladipoylamide, and N,N'-dioleylsebacoylamide, aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate; grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The particularly preferred class of release agent (wax) in the present invention may include aliphatic hydrocarbon waxes because of good dispersibility within the resin. Specific examples of the wax preferably used in the present invention may include e.g., a low-molecular weight alkylene polymer obtained through polymerization of an alkylene by radical polymerization under a high pressure or in the presence of a Ziegler catalyst under a low pressure; an alkylene polymer obtained by thermal decomposition of an alkylene polymer of a high molecular weight; and a hydrocarbon wax obtained by subjecting a mixture gas containing carbon monoxide and hydrogen to the Arge process to form a hydrocarbon mixture and distilling the hydrocarbon mixture to recover a residue. Fractionation of wax may preferably be performed by the press sweating method, the solvent method, vacuum distillation or fractionating crystallization. As the source of the hydrocarbon wax, it is preferred to use hydrocarbons having up to several hundred carbon atoms as obtained through synthesis from a mixture of carbon monoxide and hydrogen in the presence of a metal oxide catalyst (generally a composite of two or more species), e.g., by the Synthol process, the Hydrocol process (using a fluidized catalyst bed), and the Arge process (using a fixed catalyst bed) providing a product rich in waxy hydrocarbon, and hydrocarbons obtained by polymerizing an alkylene, such as ethylene, in the presence of a Ziegler catalyst, as they are rich in saturated long-chain linear hydrocarbons and accompanied with few branches. It is further preferred to use hydrocarbon waxes synthesized without polymerization because of their structure and molecular weight distribution suitable for easy fractionation.

As for the molecular weight distribution of the wax, it is preferred that the wax shows a peak in a molecular weight region of 400–2400, further 450–2000, particularly 500–1600. By satisfying such molecular weight distribution, the resultant toner is provided with preferable thermal characteristics.

The release agent, when used, may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

A flowability-improving agent may be blended with the toner to improve the flowability of the toner. Examples thereof may include: powder of fluorine-containing resin, such as polyvinylidene fluoride fine powder and polytetrafluoroethylene fine powder; titanium oxide fine powder, hydrophobic titanium oxide fine powder; fine powdery silica such as wet-process silica and dry-process silica, and treated silica obtained by surface-treating (hydrophobizing) such fine powdery silica with silane coupling agent, titanium coupling agent, silicone oil, etc.; titanium oxide fine powder, hydrophobized titanium oxide fine powder; aluminum oxide fine powder, and hydrophobized aluminum oxide fine powder.

A preferred class of the flowability-improving agent includes dry process silica or fumed silica obtained by vapor-phase oxidation of a silicon halide. For example, silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HC1.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 pm, particularly 0.002–0.2 pm.

Commercially available fine silica powder formed by vapor phase oxidation of a silicon halide to be used in the present invention include those sold under the trade names as shown below.

| | |
|---|---|
| AEROSIL<br>(Nippon Aerosil Co.) | 130<br>200<br>300<br>380<br>OX 50<br>TT 600<br>MOX 80<br>COK 84 |
| CAB-O-SIL<br>(Cabot Co.) | M-5<br>MS-7<br>MS-75<br>HS-5<br>EH-5 |
| WACKER HDK<br>(WACKER-CHEMIE GMBH) | N 20<br>V 15<br>N 20E<br>T 30<br>T 40 |
| D-C Fine Silica<br>(Dow Corning Co.)<br>FRANSOL<br>(Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldi-siloxane, 1,3-diphenyltetramethyldisiloxane, and dimethylpolysiloxane having 2 to 12 siloxane units per molecule and containing each one hydroxyl group bonded to Si at the terminal units. These may be used alone or as a mixture of two or more compounds.

It is also possible to use a flowability-improving agent by treating the above-mentioned dry-process silica with an amino group-containing silane coupling agent or silicone oil as shown below:

As a silicone oil, it is possible to use an amino-modified silicone oil having a partial structure including an amino group in its side chain as shown below:

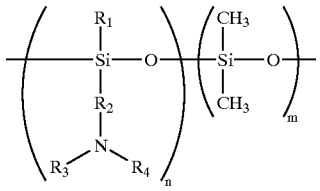

wherein $R_1$ denotes hydrogen, alkyl group, aryl group or alkoxy group; $R_2$ denotes alkylene group or phenylene group; $R_3$ and $R_4$ denote hydrogen, alkyl group or aryl group with the proviso that the alkyl group, aryl group, alkylene group and/or phenylene group can contain an amino group or another substituent, such as halogen, within an extent of not impairing the chargeability. m and n denote a positive integer.

Commercially available examples of the amino group-containing silicone oil may include the following:

$H_2NCH_2CCH_2CH_2Si\ (OCH_3)_3$ $H_2NCH_2CCH_2CH_2Si\ (OC_2H_5)_3$ $H_2NCH_2CH_2CH_2Si(CH_3)\ (OCH_3)_2$ $H_2NCH_2CH_2NHCH_2CH_2CH_2Si(CH_3)\ (OCH_3)_2$ $H_2NCONHCH_2CH_2CH_2Si\ (OC_2H_5)_3$ $H_2NCH_2CH_2NHCH_2CH_2CH_2Si\ (OCH_3)_3$ $H_2NCH_2CH_2NHCH_2CH_2NHCH_2CH_2CH_2Si\ (OCH_3)_3$ $H_3C_2OCOCH_2CH_2NHCH_2CH_2CH_2Si\ (OCH_3)_3$ $H_5C_2OCOCH_2CH_2NHCH_2CH_2NHCH_2CH_2CH_2Si\ (OCH_3)_3$ $H_5C_2OCOCH_2CH_2NHCH_2CH_2CH_2NHCH_2CH_2NHCH_2CH_2NHCH_2CH_2CH_2Si(OCH_3)_3$ $H_3COCOCH_2CH_2NHCH_2CH_2NHCH_2CH_2CH_2Si\ (OCH_3)_3$ $(H_5C_2)_2N-CH_2CH_2CH_2Si\ (OCH_3)_3$

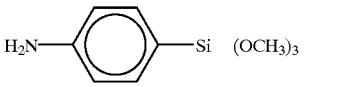

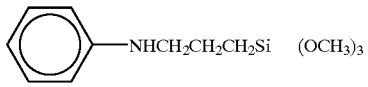

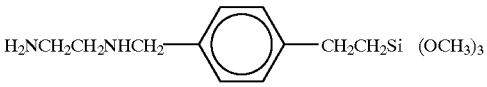

$(H_3C)_2N-C_6H_4-Si\ (OC_2H_5)_3$

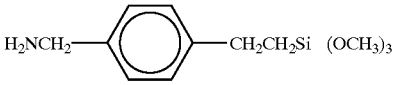

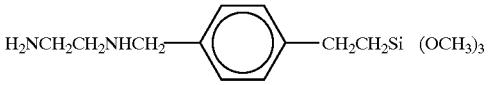

$(HOCH_2CH_2)_2N-CH_2CH_2CH_2Si\ (OCH_3)_3$ $(H_2CO)_3SiCH_2CH_2CH_2-NHCH_2$ $(H_5C_2O)_3SiCH_2CH_2CH_2NH(CH_2CH_2CH_2)SiCH_2CH_2CH_2(OC_2H_5)_3$ $H_2CNHCH_2CH_2CH_2Si\ (OC_2H_5)_3$ $H_2N\ (CH_2CH_2NH)_2CH_2CH_2CH_2Si\ (OCH_3)_3$ $H_3C-NHCONHC_3H_6Si\ (OCH_3)_3$

| Trade name (Maker) | Viscosity at 25° C. (cPs) | Amine equivalent |
|---|---|---|
| SF8417 (Toray Silicone K.K.) | 1200 | 3500 |
| KF393 (Shin'Etsu Kagaku K.K.) | 60 | 360 |
| KF857 (Shin'Etsu Kagaku K.K.) | 70 | 830 |
| KF860 (Shin'Etsu Kagaku K.K.) | 250 | 7600 |
| KF861 (Shin'Etsu Kagaku K.K.) | 3500 | 2000 |
| KF862 (Shin'Etsu Kagaku K.K.) | 750 | 1900 |
| KF864 (Shin'Etsu Kagaku K.K.) | 1700 | 3800 |
| KF865 (Shin'Etsu Kagaku K.K.) | 90 | 4400 |
| KF369 (Shin'Etsu Kagaku K.K.) | 20 | 320 |
| KF383 (Shin'Etsu Kagaku K.K.) | 20 | 320 |
| X-22-3680 (Shin'Etsu Kagaku K.K.) | 90 | 8800 |
| X-22-380D (Shin'Etsu Kagaku K.K.) | 2300 | 3800 |
| X-22-380IC (Shin'Etsu Kagaku K.K.) | 3500 | 3800 |
| X-22-3819B (Shin'Etsu Kagaku K.K.) | 1300 | 1700 |

The amine equivalent refers to a g-equivalent per amine which is equal to a value of the molecular weight of an amino group-containing silicone oil divided by the number of amino groups in the silicone oil.

The flowability-improving agent may have a specific surface area of at least 30 $m^2/g$, preferably 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner.

The toner according to the present invention may be prepared by sufficiently blending the binder resin, the long-chain compound, a magnetic or non-magnetic colorant, and a charge control agent or other additives, as desired, by a blender such as a Henschel mixer or a ball mill, followed by melt-kneading for mutual dissolution of the resins of the blend, cooling for solidification of the kneaded product, pulverization and classification to recover a toner product.

The toner may be further sufficiently blended with an external additive such as a flowability-improving agent having a chargeability to a polarity identical to that of the toner by a blender such as a Henschel mixer to obtain a toner according to the present invention, wherein the external additive is carried on the surface of the toner particles.

Various parameters referred to herein inclusive of those described in Examples appearing hereinafter are based on values measured in the following manner.

(1) Measurement of acid values and OH values 1) re: Acid value 1)1: In case of a raw material.

A sample material is accurately weighed and dissolved in a mixture solvent, and water is added thereto. The resultant liquid is titrated with 0.1N—NaOH by potentiometric titration using glass electrodes (according to JIS K1557-1970). In the case of a long-chain alkyl carboxylic acid, the titration is performed in a state of dissolution under heating.

1)-2: In case of a toner

<a> Sample preparation (Fractionation into a main binder resin, a long-chain alkyl alcohol and a long-chain alkyl carboxylic acid, and measurement of the contents).

About 1 g of sample toner is weighed and placed in a cylindrical filter paper (e.g., "No. 86R" having a size of 28 mm×100 mm, available from Toyo Roshi K. K.), and at least 500 ml of xylene heated to 120° C. or higher is dripped thereon. After the dripping, the xylene in the filtrate (solution of resinous matters including waxes, alcohols and carboxylic acid) is evaporated off, followed by drying under vacuum. Then, the thus-dried sample is weighed and placed again in a cylindrical filter paper to be placed on a Soxhlet's extractor (FIG. 3) and then subjected to extraction with 200 ml of solvent THF (tetrahydrofuran) in a Soxhlet's extractor. The extraction is performed for 6 hours and 72 hours separately. At this time, the reflux rate is controlled so that each THF extraction cycle takes about 4–5 minutes.

Figure 3:
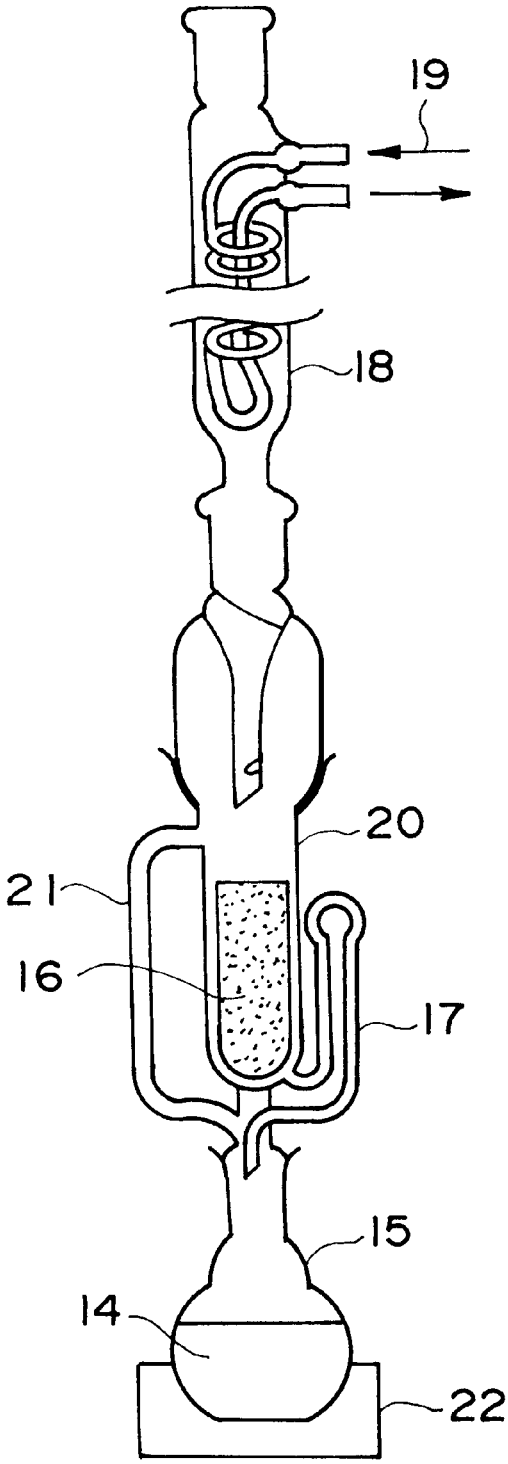
FIG. 3 is an illustration of a Soxhlet extractor.

Referring to FIG. 3, in operation, THF 14 contained in a vessel 15 is vaporized under heating-by a heater 22, and the vaporized THF is caused to pass through a pipe 21 and guided to a cooler 18 which is always cooled with cooling water 19. The THF cooled in the cooler 18 is liquefied and stored in a reservoir part containing a cylindrical filter paper 16. Then, when the level of THF exceeds that in a middle pipe 17, the THF is discharged from the reservoir part to the vessel 15 through the pipe 17. During the operation, the toner or resin in the cylindrical filter paper is subjected to extraction with the thus circulating THF.

After the extraction, the cylindrical filter paper is taken out and dried to weigh the extraction residue. The extraction residue includes a long-chain alkyl alcohol (a g), a long-chain alkyl carboxylic acid (b g) and other THF-insoluble matters (a g) inclusive of hydrocarbons such as low-molecular weight polyethylene or polypropylene and the above-mentioned release agent.

Then the filtrate liquid is dried and weighed in the above-described manner to obtain the amount of the principal binder resin (R g).

The acid values of the above-mentioned low-molecular weight component and high-molecular weight component for a vinyl resin is measured by subjecting the principal binder resin thus obtained to fractionation by using a GPC apparatus equipped with a fractionating sampler to recover a sample liquid containing a component having a molecular weight of at most $4.5\times10^4$ and a sample liquid containing a component having a molecular weight of above $4.5\times10^4$, which are then dried to provide samples for measurement of acid values in the same manner as in 1)-1.

<b> Measurement of acid values

The materials recovered in <a> above inclusive of a long-chain alkyl alcohol, a long-chain alkyl carboxylic acid, a principal binder resin and molecular weight-fractions thereof, are used as samples for measurement.

A mixture including a plurality among the long-chain alkyl alcohol, long-chain alkyl carboxylic acid, hydrocarbons, and release agent may be subjected to a measurement as it is. Alternatively, it is also possible to fractionate the mixture into the respective components by gas-liquid chromatography and also measure the contents and acid values of the respective components.

The method of measurement of the acid value of each sample material is the same as in 1)-1 above.

2) re: Hydroxyl value (OH value)

2)-1 In case of a raw material

A sample is accurately weighed into a 100 ml-volumetric flask, and 5 ml of an acetylating agent is accurately added thereto. Then, the system is heated by dipping into a bath of 100° C. ±5° C. After 1 –2 hours, the flask is taken out of the bath and allowed to cool by standing, and water is added thereto, followed by shaking to decompose acetic anhydride. In order to complete the decomposition, the flask is again heated for more than 10 min. by dipping into the bath. After cooling, the flask wall is sufficiently washed with an organic solvent. The resultant liquid is titrated with a N/2-potassium hydroxide solution in ethyl alcohol by potentiometric titration using glass electrodes (according to JIS K0070-1966). The OH value of a long-chain alkyl alcohol may be measured according to ASTM E-222, TEST METHOD B.

2)-2 In case of a toner

The samples are prepared in the same manner as those for the acid value measurement.

A sample is accurately measured into a 100 ml-volumetric flask, and 50 ml of xylene is added thereto, followed by dissolution at 120° C. on an oil bath. A blank liquid is also prepared by placing 50 ml of xylene in another volumetric flask. The following operation is performed for both the sample liquid and the blank liquid in parallel. After the dissolution, 5 ml of a mixture liquid of acetic anhydride/pyridine (=¼) is added. After heating for at least 3 hours, the oil bath temperature is set to 80° C., and a small amount of water is added thereto, followed by standing for 2 hours and cooling by standing. Then, the flask wall is sufficiently washed with a small amount of an organic solvent. Then, after adding a phenolphthalein indicator (methanol solution), the resultant liquid is titrated with 0.5N-KOH/methanol titrating liquid by potentiometric titration to obtain the OH value according to the following scheme:

$$\text{OH value}=28.05\times f\times(Tb-Ts)/S+A,$$

wherein S denotes sample weight (g); Ts, an amount of the titrating liquid required for titrating the sample (ml); Tb, an amount of the titrating liquid required for titrating the blank (ml); and A, an acid value of the sample in case of a principal binder resin only.

3) Acid value and OH value of a toner in consideration of the content factors

The acid value and OH value should be considered taking the contents of principal binder resin (R g), long-chain alkyl alcohol (a g), long-chain alkyl carboxylic acid (b g) and arbitrary component(s) (α g) into consideration as follows:

The left side of formula $(1)_f$=fr×(acid value of principal binder resin measured in <b>)+fa ×(OH value of long-chain alkyl alcohol measured in <b>).

The right side of formula $(1_f$=(¼)×fr×(OH value of principal binder resin measured by <b>).

The left side of formula $(2)_f$=fr×(acid value of principal binder resin measured in <b>)+fc ×(acid value of long-chain alkyl carboxylic acid measured in <b>).

The right side of formula $(2)_f$=(¼)×fr×(OH value of principal binder resin measured by <b>).

In the above, fr, fa and fc are as follows:

fr=(R/(a+b+α+R)): content factor of principal binder resin fa=(a/(a+b+α+R)): content factor of long-chain alkyl alcohol fc=(b/(a+b+α+R)): content factor of long-chain alkyl carboxylic acid. Arbitrary component α is a THF-insoluble resinous matter other than the long-chain alkyl alcohol and long-chain carboxylic acid. Further, when the long-chain compound is the long-chain alkyl alcohol, fr and fa are as follows:

fr=(R/(a+α+R)) and fa=(a/(a+α+R)) where R, a and α are as above, since b=o.

(2) Glass transition temperature Tq

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in a normal temperature—normal humidity environment in parallel with a black aluminum pan as a reference.

In the course of temperature increase, a main absorption peak appears in the temperature region of 40–100° C.

In this instance, the glass transition temperature is determined as a temperature of an intersection between a DSC curve and an intermediate line passing between the base lines obtained before and after the appearance of the absorption peak.

(3) Molecular weight distribution (for resin)

The molecular weight (distribution) of a binder resin may be measured based on a chromatogram obtained by GPC (gel permeation chromatography).

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.6 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K. K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6–10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3–2\times10^6$. A preferred example thereof may be a combination of μ-styragel 500, $10^3$, $10^4$ and $10^5$ available from Waters Co.; a combination of Shodex KF-801, 802, 803, 804 and 805 available from Showa Denko K. K.; or a combinations of TSK gel G1000H, G2000H, G2500H, G3000H, G4000H, G5000H, G6000H, G7000H, and GMH available from Toso K. K.

(4) Molecular weight distribution (for long-chain alkyl alcohol, long-chain alkyl carboxylic acid The molecular weight (distribution) of a long-chain alkyl alcohol or a long-chain alkyl carboxylic acid may be measured by GPC under the following conditions:

Apparatus: "GPC-150C" (available from Waters Co.)

Column: "GMH-HT" 30 cm-binary (available from Toso K. K.)

Temperature: 135° C.

Solvent: o-dichlorobenzene containing 0.1 % of ionol.

Flow rate: 1.0 ml/min.

Sample: 0.4 ml of a 0.15 %-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

Figure 2:
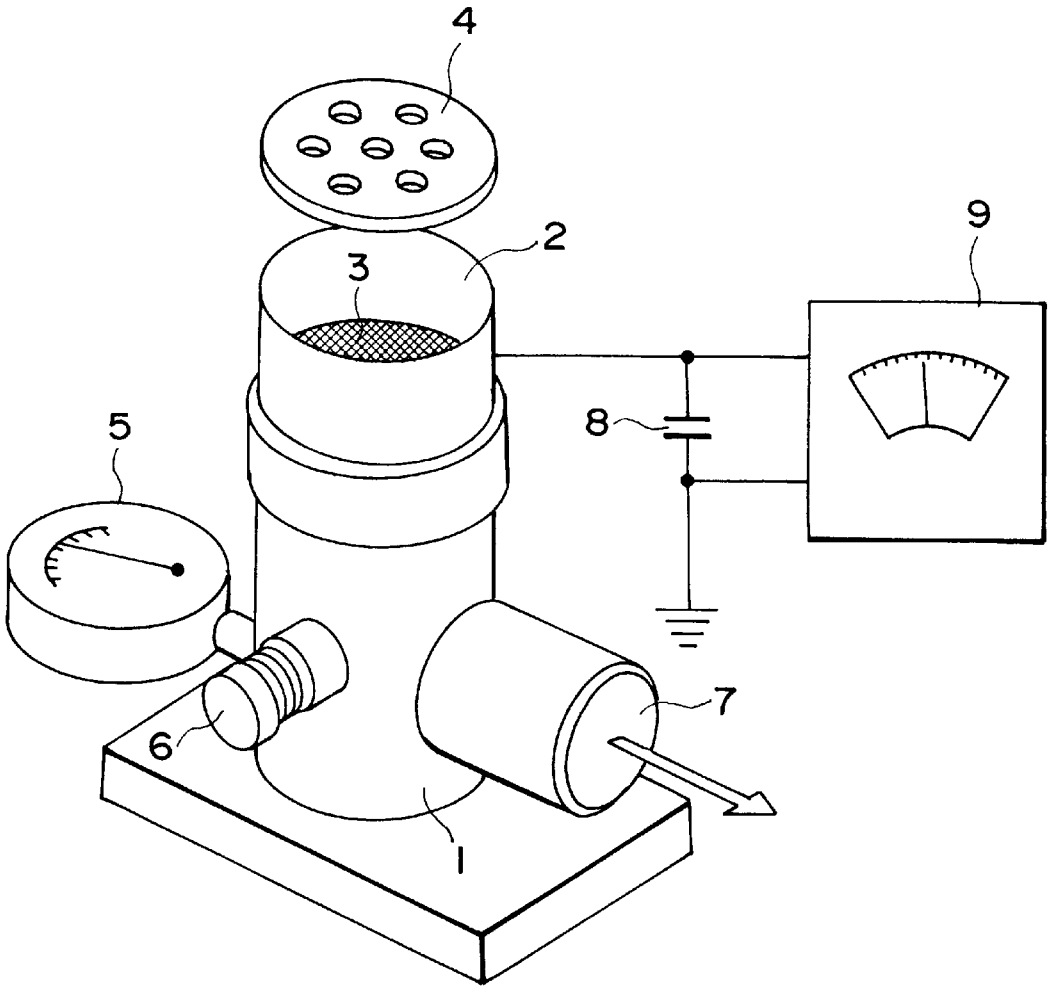
FIG. 2 is an illustration of an apparatus for measuring a triboelectric charge of a toner.

(5) Toner charge (FIG. 2)

A developer sampled from a layer on a developer carrying member is weighed and placed in a metal-made measuring container 2 equipped with an electroconductive screen 3 of 500 mesh (capable of being changed into another size so as not to allow passage of magnetic carrier particles) at the bottom and covered with a metal lid 4. The total weight of the container 2 is weighed and denoted by $W_1$ (g). Then, an aspirator 1 composed of an insulating material at least with respect to a part contacting the container 2 is operated to suck the toner through a suction port 7 to set a pressure at a vacuum gauge 5 at 250 mmAg while adjusting an aspiration control valve 6. In this state, the aspiration is performed sufficiently (for ca. 2 min.) to remove the toner. The reading at this time of a potential meter 9 connected to the container 2 via a capacitor 8 having a capacitance C ($\mu$F) is measured and denoted by V (volts). The total weight of the container after the aspiration is measured and denoted by $W_2$ (g). Then, the triboelectric charge T ($\mu$C/g) of the toner is calculated according to the following formula:

$$T\ (\mu C/g)=(C\times V)/(W_1-W_2).$$

Hereinbelow, the present invention will be described with reference to Production Examples and Examples for evaluation of image forming performances.

Resin Production Example 1

| | |
|---|---|
| Terephthalic acid | 16 mol. % |
| Fumaric acid | 18 mol. % |
| Trimellitic anhydride | 15 mol. % |
| Bisphenol derivatives of the above-described formula (A) | |
| (R = propylene, x + y = 2.2) | 30 mol. % |
| (R = ethylene, x + y = 2.2) | 18 mol. % |

The above ingredients were subjected to polycondensation to obtain a polyester (called "Resin A-1") having Mn=4,000, Mw=35,000, Tg=63° C., acid value=20, OH value =16.

Resin Production Example 2

| | |
|---|---|
| Terephthalic acid | 10 mol. % |
| Fumaric acid | 18 mol. % |
| Adipic acid | 10 mol. % |
| Trimellitic anhydride | 10 mol. % |
| Bisphenol derivatives of the above-described formula (A) | |
| (R = propylene, x + y = 2.2) | 17 mol. % |
| (R = ethylene, x + y = 2.2) | 35 mol. % |

The above ingredients were subjected to polycondensation to obtain a polyester (called "Resin B-1") having Mn=3,000, Mw=22,000, Tg=61° C., acid value=12, OH value =56.

Resin Production Examples 3 –12

Polycondensation was repeated in a similar manner as in the above Resin Production Examples while changing the ingredients as shown in the following Table 1 to prepare Polyest Resins C-1 to L-1 having properties also shown in Table 1.

Separately, long-chain alkyl alcohols α-1 to α-13 were prepared by changing the polymerization conditions and long-chain alkyl carboxylic acids β-1 to β-3 were obtained by oxidation of such long-chain alkyl alcohols, as shown in Table 2.

TABLE 1

| Resin | Composition | Acid value | OH value | Tg | Molecular weight Mn | Mw |
|---|---|---|---|---|---|---|
| A-1 | TPA/FA/TMA//PO-BPA/EO-BPA | 20 | 16 | 63 | 4,000 | 35,000 |
| B-1 | TPA/FA/AA/TMA//PO-BPA/EO-BPA | 12 | 56 | 61 | 3,000 | 22,000 |
| C-1 | IPA/SA/TMA//PO-BPA/EO-BPA | 35 | 25 | 60 | 3,800 | 75,000 |
| D-1 | TPA/IPA/DSA//PO-BPA/PET/PO-NPR | 5.2 | 58 | 58 | 5,200 | 130,000 |
| E-1 | TPA/FA/DSA//PO-BPA/PO-NPR/EO-NPR | 3.0 | 65 | 62 | 4,600 | 49,000 |
| F-1 | TPA/IPA/SA//PO-BPA/PO-NPR/EO-NPR | 2.5 | 72 | 57 | 2,400 | 28,000 |
| G-1 | TPA/DSA/TMA//PO-BPA/EO-BPA | 48 | 15 | 59 | 4,300 | 52,000 |
| H-1 | IPA/DSA/TMA/BTCA//PO-BPA/EO-BPA | 56 | 10 | 62 | 4,100 | 48,000 |
| I-1 | TPA/SA/TMA/BTCA//PO-BPA/EO-BPA | 65 | 2 | 64 | 3,700 | 43,000 |
| J-1 | IPA/TPA/FA//PO-BPA/PET/PO-NPR | 1.0 | 56 | 55 | 4,500 | 160,000 |
| K-1 | TPA/AA/DSA/BTCA//PO-BPA/EO-BPA | 81 | 1.0 | 65 | 1,400 | 9,500 |
| L-1 | TPA/IPA/FA/OSA//PO-BPA/PO-NPR/EO-NPR | 4.0 | 82 | 54 | 4,300 | 94,000 |

TPA: terephthalic acid
FA: fumaric acid
TMA: trimellitic anhydride
AA: adipic acid
IPA: isophthalic acid
SA: succinic acid
DSA: dodecenylsuccinic acid
BTCA: benzophenonetetracarboxylic acid
PO-BPA: bisphenol derivative of formula (A) (R = propylene)
EO-BPA: bisphenol derivative of formula (A) (R = ethylene)
PET: pentaerythritol
PO-NPR: propylene oxide-added novolak-type phenolic resin
EO-NPR: ethylene oxide-added novolak-type phenolic resin

TABLE 2

| Material*1 | OH value (acid value) | X (or Y) | Molecular weight Mn | Mw | Mw/Mn | m.p.*2 (° C.) | Content*3 (wt %) |
|---|---|---|---|---|---|---|---|
| α-1 | 70 | 48 | 440 | 870 | 2.0 | 108 | 60 |
| α-2 | 90 | 38 | 280 | 800 | 2.9 | 100 | 58 |
| α-3 | 22 | 170 | 1,800 | 3,900 | 2.2 | 115 | 96 |
| α-4 | 12 | 210 | 2,300 | 4,300 | 1.9 | 135 | 98 |
| α-5 | 28 | 120 | 1,600 | 7,700 | 4.8 | 105 | 92 |
| α-6 | 65 | 52 | 620 | 2,000 | 3.2 | 110 | 57 |
| α-7 | 98 | 38 | 230 | 580 | 2.5 | 98 | 58 |
| α-8 | 118 | 36 | 170 | 780 | 4.6 | 92 | 50 |
| α-9 | 122 | 28 | 240 | 530 | 2.2 | 88 | 35 |
| α-10 | 78 | 52 | 370 | 2,200 | 5.9 | 100 | 48 |
| α-11 | 4 | 260 | 2,700 | 8,400 | 3.1 | 150 | 99 |
| α-12 | 155 | 22 | 140 | 370 | 2.6 | 75 | 30 |
| α-13 | 1 | 320 | 4,100 | 11,000 | 2.7 | 165 | 99 |
| β-1 | (90) | (38) | 300 | 820 | 2.7 | 105 | 58 |
| β-2 | (55) | (60) | 670 | 1,500 | 2.2 | 115 | 65 |
| β-3 | (22) | (140) | 1,600 | 3,000 | 1.9 | 140 | 95 |

*1α-1 to 13: long-chain alkyl alcohol
β-1 to 3: long-chain alkyl carboxylic acid
*2m.p. = melting point
*3Content (wt. %) of long-chain alkyl alcohol having 37 or more carbon atoms or long-chain alkyl carboxylic acid having 38 or more carbon atoms.

EXAMPLE 1

| | |
|---|---|
| Resin A-1 | 100 wt. parts |
| Magnetic iron oxide (average particle size (Dav.) = 0.15 μm, Hc = 115 oersted, $\sigma_s$ = 80 emu/g, $\sigma_r$ = 11 emu/g) | 90 wt. parts |
| Long-chain alkyl alcohol (α-1) of Formula (3) (x = 48, OH value 70, Mn = 440, Mw = 870, Mw/Mn = 2.0, m.p. = 108° C., alcohol (≧$C_{37}$) content = 60 wt. %) | 5 wt. parts |
| Mono-azo metal complex | 2 wt. parts |

(negative charge control agent)

The above ingredients were pre-mixed by a Henschel mixer and melt-kneaded through a twin-screw extruder at 130° C. After cooling, the melt-kneaded product was coarsely crushed by a cutter mill and finely pulverized by a jet stream pulverizer, followed by classification by a pneumatic classifier to obtain a magnetic toner having a weight-average particle size of 6.2 μm. To 100 wt. parts of the magnetic toner, 1.0 wt. part of hydrophobic dry-process silica (BET specific surface area ($S_{BET}$)=300 $m^2/g$) was externally added to obtain a magnetic toner.

The magnetic toner was charged into a digital copying machine ("GP-55", mfd. by Canon K. K.) to be evaluated with respect image characteristics, whereby good results as shown in Table 6 appearing hereinafter were obtained. Further, a fixing test was performed by taking out the fixing apparatus of the copying machine so as to use it as an externally driven fixing apparatus equipped with a temperature controller at various fixing speeds, whereby good results also as shown in Table 6 were obtained.

As for the image characteristic evaluation, the density gradation characteristic was good because of a fast charging speed and a stable saturation charge. Accompanying this, an undesirable phenomenon of selective development that a developer fraction of a small particle size is selectively consumed could be obviated. The halftone images were free from change in image quality from the initial stage, free from density irregularity, smooth and good.

EXAMPLES 2–27

Magnetic toners were prepared and evaluated in the same manner as in Example 1 except that the binder resin, long-chain alkyl alcohol and long-chain alkyl carboxylic acid were changed as shown in Tables 3 –4, whereby good results as shown in Tables 6 –8 were obtained. The particle size of the toner after copying of 20,000 sheets was not substantially different from that in initial stage, and good image characteristics were continually obtained.

EXAMPLE 28

| | |
|---|---|
| Classified fine powder obtained in Example 1 | 60 wt. parts |
| Resin A-1 | 100 wt. parts |
| Magnetic iron oxide used in Example 1 | 90 wt. parts |
| Long-chain alkyl alcohol (α-1) used in Example 1 | 5 wt. parts |
| Monoazo metal complex used in Example 1 | 2 wt. parts |

A magnetic toner was prepared and evaluated in the same manner as in Example 1, whereby good results as shown in Table 8 were obtained.

Comparative Examples 1 –10

Magnetic toners were prepared and evaluated in the same manner as in Example 1 except that the binder resin, long-chain alkyl alcohol and long-chain alkyl carboxylic acid were changed as shown in Table 5, whereby results as shown in Table 9 were obtained.

Comparative Example 11

A toner reproduction process similarly as in Example 28 was repeated by using classified fine powder obtained in Comparative Example 1 and the materials used in Comparative Example 1, whereby results shown in Table 9 were obtained.

TABLE 3

| | Binder resin (100 wt. parts) | | | Alcohol or carboxylic acid | | | Formula $(1)_f$ or/and $(2)_f$ | | |
|---|---|---|---|---|---|---|---|---|---|
| Example | Name | Acid value | OH value | Name | Amount wt. parts | OH or acid value | Left side (A) | Right side (B) | (A) − (B) |
| 1 | A-1 | 20 | 16 | α-1 | 5 | 70 | 22 | 4 | +18 |
| 2 | A-1 | 20 | 16 | β-1 | 5 | 90 | 23 | 4 | +19 |
| 3 | A-1 | 20 | 16 | α-1 | 5 | 70 | 25 | 4 | +21 |
| | | | | β-1 | 5 | 90 | | | |
| 4 | B-1 | 12 | 56 | α-2 | 5 | 90 | 16 | 13 | +3 |
| 5 | B-1 | 12 | 56 | β-2 | 10 | 55 | 16 | 13 | +3 |
| 6*[1] | A-1 | 20 | 16 | α-1 | 3 | 70 | 21 | 4 | +17 |
| | | | | γ | 3 | 0 | | | |
| 7 | B-1 | 12 | 56 | α-2 | 20 | 90 | 25 | 12 | +13 |
| 8 | C-1 | 35 | 25 | α-1 | 5 | 70 | 37 | 6 | +31 |
| 9 | D-1 | 5.2 | 58 | α-2 | 20 | 90 | 19 | 12 | +7 |
| 10 | E-1 | 3.0 | 65 | α-2 | 20 | 90 | 18 | 14 | +4 |
| 11 | F-1 | 2.5 | 72 | α-2 | 20 | 90 | 17 | 15 | +2 |
| 12 | G-1 | 48 | 15 | α-1 | 5 | 70 | 49 | 4 | +45 |
| 13 | H-1 | 56 | 10 | α-1 | 5 | 70 | 57 | 2 | +55 |

*[1]In example 6, γ (denoting low-molecular weight ethylene/propylene copolymer having a molecular weight of 700 (prepared by a low-pressure Ziegler process) was used in addition to the alcohol α-1.

TABLE 4

| | Binder resin (100 wt. parts) | | | Alcohol or carboxylic acid | | | Formula $(1)_f$ or/and $(2)_f$ | | |
|---|---|---|---|---|---|---|---|---|---|
| Example | Name | Acid value | OH value | Name | Amount wt. parts | OH or acid value | Left side (A) | Right side (B) | (A) − (B) |
| 14 | I-1 | 65 | 2 | α-1 | 5 | 70 | 65 | 0.5 | +64.5 |
| 15 | C-1 | 35 | 25 | α-2 | 5 | 90 | 38 | 6 | +32 |
| 16 | C-1 | 35 | 25 | α-3 | 5 | 22 | 34 | 6 | +28 |
| 17 | C-1 | 35 | 25 | α-4 | 5 | 12 | 34 | 6 | +28 |
| 18 | C-1 | 35 | 25 | α-5 | 5 | 28 | 35 | 6 | +29 |
| 19 | C-1 | 35 | 25 | α-6 | 5 | 65 | 36 | 6 | +30 |
| 20 | C-1 | 35 | 25 | α-7 | 5 | 98 | 38 | 6 | +32 |
| 21 | C-1 | 35 | 25 | α-8 | 5 | 118 | 39 | 6 | +33 |
| 22 | C-1 | 35 | 25 | β-3 | 5 | 22 | 34 | 6 | +28 |
| 23*2 | C-1 | 35 | 25 | α-1 | 30 | 70 | 43 | 5 | +38 |
| 24*3 | C-1 | 35 | 25 | α-1 | 35 | 70 | 44 | 5 | +39 |
| 25 | K-1 | 81 | 1.0 | α-1 | 5 | 70 | 80 | 0.2 | +79.8 |
| 26 | C-1 | 35 | 25 | α-10 | 5 | 78 | 37 | 5 | +31 |
| 27 | B-1 | 12 | 56 | α-4 | 3 | 12 | 12 | 14 | −2 |

*[2]Pulverizability in toner production step was somewhat inferior.
*[3]Pulverizability in toner production step was further inferior than in Example 23.

TABLE 5

| | Binder resin (100 wt. parts) | | | Alcohol or carboxylic acid | | | Formula $(1)_f$ or/and $(2)_f$ | | |
|---|---|---|---|---|---|---|---|---|---|
| Comparative Example | Name | Acid value | OH value | Name | Amount wt. parts | OH or acid value | Left side (A) | Right side (B) | (A) − (B) |
| 1*[4] | A-1 | 20 | 16 | γ | 5 | 0 | 19 | 4 | +15 |
| 2 | B-1 | 12 | 56 | α-13 | 3 | 1 | 12 | 14 | −2 |
| 3 | D-1 | 5.2 | 58 | α-11 | 5 | 4 | 5 | 14 | −9 |
| 4 | C-1 | 35 | 25 | — | — | — | 35 | 6 | +29 |
| 5 | J-1 | 1.0 | 56 | α-13 | 5 | 1 | 1 | 13 | −12 |
| 6 | L-1 | 4.0 | 82 | α-11 | 5 | 4 | 4 | 20 | −16 |
| 7 | C-1 | 35 | 25 | α-9 | 5 | 122 | 39 | 6 | +33 |

TABLE 5-continued

| Comparative Example | Binder resin (100 wt. parts) Name | Acid value | OH value | Alcohol or carboxylic acid Name | Amount wt. parts | OH or acid value | Formula $(1)_f$ or/and $(2)_f$ Left side (A) | Right side (B) | (A) − (B) |
|---|---|---|---|---|---|---|---|---|---|
| 8 | C-1 | 35 | 25 | α-11 | 5 | 4 | 33 | 6 | +27 |
| 9 | C-1 | 35 | 25 | α-12 | 5 | 155 | 41 | 6 | +35 |
| 10 | C-1 | 35 | 25 | α-13 | 5 | 1 | 33 | 6 | +27 |

*4γ denotes the low-molecular weight ethylene/propylene copolymer (γ) used in Example 6 (Table 3).

TABLE 6*1

| | Image characteristics | | | | | | | | | | | | Fixing performance*4 | | | |
|---|---|---|---|---|---|---|---|---|---|---|---|---|---|---|---|---|
| | Initial | | | | | | After 20,000 sheets | | | | | | 50 mm/sec | | 500 mm/sec | |
| Ex. | Dmax*3 | Gradation | Halftone | Line scatter | Dav. (μm) | Charge (μC/g) | Dmax. | Gradation | Halftone | Dav. (μm) | Charge (μC/g) | E.S. | Solid black (D = 1.4) | Halftone (D = 0.5) | Solid black (D = 1.4) | Halftone (D = 0.5) |
| 1 | ○ 1.45 | ○ | ○ | ○ | 6.2 | −16.5 | ○ 1.45 | ○ | ○ | 6.4 | −16.2 | ○ | ○ 140° C. | ○ | ○ 170° C. | ○ |
| 2 | ○ 1.45 | ○ | ○ | ○ | 5.8 | −18.8 | ○ 1.45 | ○ | ○ | 6.1 | −18.2 | ○ | ○ 140° C. | ○ | ○ 170° C. | ○ |
| 3 | ○ 1.45 | ○ | ○ | ○ | 6.0 | −17.0 | ○ 1.45 | ○ | ○ | 6.2 | −17.0 | ○ | ○ 140° C. | ○ | ○ 170° C. | ○ |
| 4 | ○ 1.40 | ○ | ○ | ○ | 6.3 | −15.0 | ○ 1.40 | ○ | ○Δ | 6.8 | −14.7 | ○Δ | ○ 140° C. | ○ | ○ 175° C. | ○ |
| 5 | ○ 1.42 | ○ | ○ | ○ | 6.5 | −15.0 | ○ 1.42 | ○ | ○ | 6.8 | −15.0 | ○Δ | ○ 145° C. | ○Δ | ○ 175° C. | ○ |
| 6 | ○ 1.45 | ○ | ○ | ○ | 6.8 | −15.5 | ○ 1.45 | ○ | ○ | 7.0 | −15.0 | ○ | ○ 140° C. | ○ | ○ 170° C. | ○ |
| 7 | ○ 1.42 | ○ | ○ | ○ | 6.5 | −15.0 | ○ 1.40 | ○ | ○ | 6.7 | −14.8 | ○Δ | ○ 140° C. | ○ | ○ 170° C. | ○ |
| 8 | ○ 1.48 | ○ | ○ | ○ | 6.4 | −16.5 | ○ 1.48 | ○ | ○ | 6.6 | −16.5 | ○ | ○ 140° C. | ○ | ○ 170° C. | ○ |
| 9 | ○ 1.40 | ○ | ○ | ○ | 6.5 | −15.0 | ○ 1.40 | ○ | ○ | 6.6 | −14.5 | ○Δ | ○ 150° C. | ○ | ○ 175° C. | ○ |
| 10 | ○ 1.40 | ○ | ○ | ○ | 6.7 | −13.0 | ○ 1.40 | ○ | ○Δ | 6.8 | −14.0 | ○Δ | ○ 140° C. | ○Δ | ○ 170° C. | ○Δ |

Notes are found after Table 9.

TABLE 7*1

| | Image characteristics | | | | | | | | | | | | Fixing performance*4 | | | |
|---|---|---|---|---|---|---|---|---|---|---|---|---|---|---|---|---|
| | Initial | | | | | | After 20,000 sheets | | | | | | 50 mm/sec | | 500 mm/sec | |
| Ex. | Dmax*3 | Gradation | Halftone | Line scatter | Dav. (μm) | Charge (μC/g) | Dmax. | Gradation | Halftone | Dav. (μm) | Charge (μC/g) | E.S. | Solid black (D = 1.4) | Halftone (D = 0.5) | Solid black (D = 1.4) | Halftone (D = 0.5) |
| 11 | ○Δ 1.39 | ○ | ○Δ | ○Δ | 6.5 | −11.0 | ○Δ 1.39 | ○ | ○Δ | 7.0 | −12.5 | ○Δ | ○ 140° C. | ○Δ | ○ 170° C. | ○Δ |
| 12 | ○ 1.47 | ○ | ○ | ○ | 6.6 | −18.0 | ○ 1.47 | ○ | ○ | 6.7 | −18.0 | ○ | ○ 140° C. | ○ | ○ 170° C. | ○ |
| 13 | ○ 1.45 | ○ | ○ | ○ | 6.5 | −18.2 | ○ 1.45 | ○ | ○ | 6.8 | −18.0 | ○Δ | ○ 140° C. | ○ | ○ 170° C. | ○ |
| 14 | ○ 1.42 | ○ | ○ | ○ | 6.5 | −17.5 | ○ 1.40 | ○Δ | ○Δ | 7.2 | −16.5 | ○Δ | ○ 140° C. | ○ | ○ 170° C. | ○ |
| 15 | ○ 1.45 | ○ | ○ | ○ | 6.7 | −15.8 | ○ 1.45 | ○ | ○ | 7.0 | −15.0 | ○ | ○ 140° C. | ○ | ○ 170° C. | ○ |
| 16 | ○ 1.45 | ○ | ○ | ○ | 6.5 | −15.0 | ○ 1.45 | ○ | ○ | 7.0 | −14.5 | ○ | ○ 140° C. | ○ | ○ 170° C. | ○ |
| 17 | ○ 1.40 | ○ | ○ | ○Δ | 6.5 | −12.0 | ○ 1.40 | ○ | ○ | 6.8 | −11.0 | ○Δ | ○ 145° C. | ○ | ○ 175° C. | ○ |
| 18 | ○ 1.40 | ○ | ○ | ○Δ | 6.6 | −12.2 | ○ 1.40 | ○ | ○ | 7.0 | −11.5 | ○Δ | ○ 140° C. | ○ | ○ 170° C. | ○ |
| 19 | ○ 1.42 | ○ | ○ | ○ | 6.5 | −14.5 | ○ 1.42 | ○ | ○ | 6.8 | −14.5 | ○Δ | ○ 150° C. | ○ | ○ 175° C. | ○ |

TABLE 7*[1]-continued

| | Image characteristics | | | | | | | | | | | | Fixing performance*[4] | | | |
|---|---|---|---|---|---|---|---|---|---|---|---|---|---|---|---|---|
| | Initial | | | | | | After 20,000 sheets | | | | | | 50 mm/sec | | 500 mm/sec | |
| Ex. | Dmax*[3] | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Halftone (D = 0.5) | Solid black (D = 1.4) | Halftone (D = 0.5) |
| 20 | ○ 1.44 | ○ | ○ | ○ | 6.5 | −14.8 | ○ 1.44 | ○ | ○ | 6.8 | −14.8 | ○Δ | ○ 140° C. | ○Δ | ○ 170° C. | ○ |

Notes are found after Table 9.

TABLE 8*[1]

| | Image characteristics | | | | | | | | | | | | Fixing performance*[4] | | | |
|---|---|---|---|---|---|---|---|---|---|---|---|---|---|---|---|---|
| | Initial | | | | | | After 20,000 sheets | | | | | | 50 mm/sec | | 500 mm/sec | |
| Ex. | Dmax*[3] | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Halftone (D = 0.5) | Solid black (D = 1.4) | Halftone (D = 0.5) |
| 21 | ○Δ 1.38 | ○ | ○ | ○Δ | 6.7 | −13.7 | ○Δ 1.38 | ○ | Δ | 7.1 | −13.7 | ○Δ | ○ 140° C. | ○Δ | ○ 170° C. | ○Δ |
| 22 | ○ 1.40 | ○ | ○ | ○ | 6.8 | −13.8 | ○ 1.40 | ○ | ○Δ | 7.5 | −13.8 | ○Δ | ○ 150° C. | ○ | ○ 180° C. | ○Δ |
| 23 | ○ 1.43 | ○ | ○ | ○Δ | 6.5 | −13.5 | ○ 1.40 | ○ | ○Δ | 7.0 | −12.0 | ○ | ○ 140° C. | ○ | ○ 170° C. | ○ |
| 24*[5] | ○ 1.42 | ○Δ | ○Δ | ○Δ | 9.5 | −11.0 | ○ 1.38 | ○Δ | Δ | 10.0 | −9.5 | ○Δ | ○ 150° C. | ○ | ○Δ 180° C. | ○ |
| 25*[6] | ○ 1.42 | ○Δ | ○Δ | ○Δ | 6.5 | −12.0 | ○ 1.37 | ○Δ | Δ | 7.2 | −15.0 | Δ | ○ 145° C. | ○ | ○ 170° C. | ○ |
| 26*[6] | ○ 1.40 | ○Δ | ○Δ | ○Δ | 6.5 | −12.0 | ○ 1.37 | ○Δ | Δ | 7.5 | −10.0 | Δ | ○ 145° C. | ○ | ○ 170° C. | ○ |
| 27 | ○Δ 1.37 | ○Δ | Δ | Δ | 6.2 | −13.5 | ○Δ | ○Δ | Δ | 8.2 | −11.9 | Δ | ○ 145° C. | ○Δ | ○ 175° C. | ○Δ |
| 28 | ○ 1.44 | ○ | ○ | ○ | 6.5 | −16.0 | ○ 1.40 | ○ | ○ | 6.6 | −15.8 | ○ | ○ 140° C. | ○ | ○ 170° C. | ○ |

Notes are found after Table 9.

TABLE 9*[1]

| | Image characteristics | | | | | | | | | | | | Fixing performance*[4] | | | |
|---|---|---|---|---|---|---|---|---|---|---|---|---|---|---|---|---|
| | Initial | | | | | | After 20,000 sheets | | | | | | 50 mm/sec | | 500 mm/sec | |
| Comp. Ex. | D-max *[3] | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Halftone (D = 0.5) | Solid black (D = 1.4) | Halftone (D = 0.5) |
| 1 | ○ 1.43 | ○ | Δ | ○Δ | 6.5 | −16.5 | ΔX 1.25 | X | X | 8.5 | −13.6 | X | ○Δ 160° C. | X | Δ 190° C. | X |
| 2 | ○Δ 1.38 | ○Δ | Δ | Δ | 6.2 | −14.2 | ΔX 1.20 | X | X | 8.8 | −11.8 | X | Δ 165° C. | ΔX | Δ 190° C. | ΔX |
| 3 | ΔX 1.25 | X | Δ | Δ | 6.5 | −10.2 | Δ 1.30 | ○Δ | ΔX | 7.5 | −11.5 | ΔX | ○ 150° C. | ○ | ○ 175° C. | ○ |
| 4 | ○ 1.40 | ○Δ | Δ | Δ | 6.5 | −18.5 | ΔX 1.20 | X | X | 8.2 | −26.0 | X | ○Δ 160° C. | ΔX | Δ 190° C. | ΔX |
| 5 | X 1.10 | X | X | ΔX | 6.3 | −8.8 | ΔX 1.25 | X | X | 8.7 | −9.5 | X | ○ 145° C. | ○ | ○ 175° C. | ○ |
| 6 | X 1.10 | X | X | ΔX | 6.4 | −8.5 | ΔX 1.27 | X | ΔX | 8.5 | −9.8 | X | ○ 145° C. | ○ | ○ 175° C. | ○ |
| 7 | Δ 1.30 | Δ | ΔX | ΔX | 6.5 | −10.5 | | | *7 | | | Δ | ○ 145° C. | ○ | ○ 175° C. | ○ |
| 8 | ΔX 1.20 | X | Δ | X | 6.5 | −8.5 | ΔX 1.27 | X | X | 8.5 | −9.5 | X | ○ 145° C. | ○ | ○ 175° C. | ○ |
| 9 | Δ 1.30 | Δ | ΔX | ΔX | 6.3 | −11.0 | | | *7 | | | X | ○ 140° C. | ○ | ○ 170° C. | ○ |
| 10 | ΔX 1.15 | X | ΔX | ΔX | 6.5 | −10.0 | ΔX 1.25 | X | X | 9.0 | −9.0 | X | Δ 165° C. | ΔX | ΔX 198° C. | ΔX |
| 11 | ○Δ 1.37 | ○Δ | Δ | Δ | 6.5 | −14.5 | ΔX 1.20 | X | X | 8.8 | −10.5 | X | ○Δ 160° C. | X | Δ 190° C. | X |

Notes are found after Table 9.

Notes to Tables 6 to 9 and Tables 21 to 29

1: Every item was evaluated equally at 5 levels of o, oΔ, Δ, Δx, x (good→poor).

2: E.S. represents an environmental stability evaluated based on image qualities formed in a high temperature/high-humidity (30° C./85%) environment after standing for 24 hours.

3: Image densities including Dmax (maximum density) and D (density) were measured by using a densitometer ("Macbeth RD918", available from Macbeth Co.).

4: The temperature, such as 140° C., 145° C., . . . denotes the fixing initiation temperature.

5: The pulverizability in the toner production step was inferior so that the performances were evaluated at a larger toner particle size.

6: The cleaning web of the fixing roller was soiled.

7: The melt-sticking onto the photosensitive member occurred so that copying on 20000 sheets was impossible.

8: The pulverizability in the toner production step was somewhat inferior.

Resin Production Example 13

| | |
|---|---|
| Styrene | 80.0 wt. parts |
| Butyl acrylate | 10.0 wt. parts |
| Monobutyl maleate | 10.0 wt. parts |
| Di-tert-butyl peroxide | 6.0 wt. parts |

A mixture of the above ingredients was added dropwise to 200 wt. parts of xylene heated to a reflux temperature in 4 hours. The polymerization was completed under xylene reflux (138–144° C.), and the system was heated to 200° C. under a reduced pressure to remove the xylene, thereby obtaining a resin (called "Resin A-2").

| | |
|---|---|
| Resin A-2 | 40.0 wt. part(s) |
| Styrene | 45.0 wt. part(s) |
| Butyl acrylate | 15.0 wt. part(s) |
| Divinylbenzene | 0.5 wt. part(s) |
| Benzoyl peroxide | 1.5 wt. part(s) |

Into a mixture liquid including the above ingredients, 170 wt. parts of water containing 0.12 wt. part of partially saponified polyvinyl alcohol was added, and the resultant mixture was vigorously stirred to form a suspension liquid. Into a reaction vessel containing 50 wt. parts of water and aerated with nitrogen, the above suspension liquid was added and subjected to 8 hours of suspension polymerization at 80° C.. After completing the reaction, the product was washed with water, de-watered and dried to obtain Resin 1, which showed Tg=60° C. and Mn=$1.1\times10^4$, Mw =$1\times10^5$, acid value=17, and OH value=0.

Resin Production Example 14

The solution polymerization for obtaining Resin A-2 was repeated except for using the following composition:

| | |
|---|---|
| Styrene | 85 wt. parts |
| Butyl acrylate | 13 wt. parts |
| 2-Hydroxyethyl acrylate | 2 wt. parts |

By using the resin thus obtained, the suspension polymerization was performed otherwise similarly as in Resin Production Example 13 to obtain Resin 2, which showed Tg=58° C., Mn=1.2–$10^4$, Mw=1.2–$10^5$, acid value=0, OH value=4.

Resin Production Example 15

The solution polymerization for obtaining Resin A-2 was repeated except for using the following composition:

| | |
|---|---|
| Styrene | 85 wt. parts |
| Butyl acrylate | 15 wt. parts |

By using the resin thus obtained, the suspension polymerization was performed otherwise similarly as in Resin Production Example 13 to obtain Resin 3, which showed Tg=59° C., Mn=1.0–$10^4$, Mw=1.3–$10^5$, acid value=0, OH value=0.

Resin Production Examples 16 –46

Solution polymerization and suspension polymerization were sequentially performed similarly as in Resin Production Example 13 while changing the monomers, composition, initiator amount, and a weight ratio between the vinyl resin produced in the first polymerization and the monomers polymerized in the second polymerization, whereby resins 4–46 as shown in Tables 10–13 were obtained.

Separately, long-chain alkyl alcohols α-1 to α-13 were prepared by changing the polymerization conditions and long-chain alkyl carboxylic acids β-2 to β-4 were obtained by oxidation of such long-chain alkyl alcohols, as shown in Table 14.

TABLE 10

| | Resin | | | | Molecular weight distribution in developer | | | | |
|---|---|---|---|---|---|---|---|---|---|
| | | | | | Peak M.W. | | Areal ratio | Acid value of fraction | |
| Resin No. | Acid value | OH value | Molecular weight Mn | Molecular weight Mw | Peak 1 | Peak 2 | (≦4.5 × $10^3$/ >4.5 × $10^3$) | ≦4.5 × $10^3$ | >4.5 × $10^3$ |
| 1 | 17 | 0 | 11,000 | 100,000 | 6,400 | 330,000 | 1.4 | 25.7 | 4.8 |
| 2 | 0 | 4 | 12,000 | 120,000 | 6,700 | 340,000 | 2.6 | 0 | 0 |
| 3 | 0 | 0 | 10,000 | 130,000 | 6,500 | 350,000 | 2.5 | 0 | 0 |
| 4 | 2.0 | 0 | 7,000 | 110,000 | 5,800 | 250,000 | 3.5 | 1.9 | 2.3 |
| 5 | 3.0 | 0 | 10,000 | 120,000 | 7,000 | 200,000 | 3.2 | 3.7 | 0.8 |
| 6 | 5.5 | 0 | 8,500 | 180,000 | 7,800 | 450,000 | 3.4 | 5.8 | 4.4 |
| 7 | 8.0 | 0 | 8,000 | 250,000 | 6,000 | 700,000 | 3.3 | 9.1 | 4.3 |
| 8 | 11.0 | 0 | 17,000 | 300,000 | 10,000 | 970,000 | 2.2 | 11.6 | 9.6 |

TABLE 10-continued

| Resin | Resin | | | | Molecular weight distribution in developer | | | | |
|---|---|---|---|---|---|---|---|---|---|
| | | | | | Peak M.W. | | Areal ratio | Acid value of fraction | |
| No. | Acid value | OH value | Molecular weight Mn | Molecular weight Mw | Peak 1 | Peak 2 | ($\leqq 4.5 \times 10^3$/ $>4.5 \times 10^3$) | $\leqq 4.5 \times 10^3$ | $>4.5 \times 10^3$ |
| 9 | 25.0 | 0 | 4,000 | 222,000 | 5,700 | 750,000 | 3.4 | 29.8 | 8.8 |
| 10 | 48.0 | 0 | 3,200 | 200,000 | 5,600 | 720,000 | 3.3 | 58.5 | 12.9 |
| 11 | 52.0 | 0 | 4,300 | 340,000 | 6,300 | 775,000 | 3.5 | 61.7 | 18.0 |
| 12 | 58.0 | 0 | 5,500 | 265,000 | 11,000 | 820,000 | 4.5 | 59.9 | 49.5 |
| 13 | 62.0 | 0 | 12,000 | 370,000 | 7,300 | 830,000 | 4.5 | 63.0 | 57.7 |

TABLE 11

| Resin | Resin | | | | Molecular weight distribution in developer | | | | |
|---|---|---|---|---|---|---|---|---|---|
| | | | | | Peak M.W. | | Areal ratio | Acid value of fraction | |
| No. | Acid value | OH value | Molecular weight Mn | Molecular weight Mw | Peak 1 | Peak 2 | ($\leqq 4.5 \times 10^3$/ $>4.5 \times 10^3$) | $\leqq 4.5 \times 10^3$ | $>4.5 \times 10^3$ |
| 14 | 78.0 | 0 | 9,500 | 320,000 | 5,900 | 690,000 | 4.7 | 82.0 | 62.7 |
| 15 | 82.0 | 0 | 8,800 | 230,000 | 7,000 | 490,000 | 3.5 | 86.0 | 67.5 |
| 16 | 20.0 | 17.0 | 6,000 | 100,000 | 5,800 | 280,000 | 3.7 | 22.9 | 9.3 |
| 17 | 20.0 | 25.0 | 7,500 | 110,000 | 7,000 | 300,000 | 3.6 | 23.0 | 9.2 |
| 18 | 20.0 | 32.0 | 5,300 | 225,000 | 6,200 | 410,000 | 3.3 | 23.5 | 8.6 |
| 19 | 20.0 | 38.0 | 6,200 | 178,000 | 6,000 | 290,000 | 3.4 | 23.3 | 8.8 |
| 20 | 20.0 | 42.0 | 8,000 | 210,000 | 7,400 | 360,000 | 3.4 | 23.3 | 8.8 |
| 21 | 20.0 | 0 | 5,300 | 332,000 | 7,500 | 1,150,000 | 4.5 | 21.8 | 11.0 |
| 22 | 20.0 | 0 | 5,700 | 345,000 | 8,000 | 1,250,000 | 4.5 | 22.0 | 11.0 |
| 23 | 20.0 | 0 | 6,800 | 300,000 | 7,000 | 1,030,000 | 3.3 | 23.5 | 8.6 |
| 24 | 20.0 | 0 | 19,000 | 380,000 | 43,000 | 800,000 | 3.9 | 22.6 | 9.8 |
| 25 | 20.0 | 0 | 16,000 | 370,000 | 32,000 | 700,000 | 3.8 | 21.5 | 14.4 |
| 26 | 20.0 | 0 | 15,000 | 360,000 | 25,000 | 750,000 | 3.7 | 22.9 | 9.4 |

TABLE 12

| Resin | Resin | | | | Molecular weight distribution in developer | | | | |
|---|---|---|---|---|---|---|---|---|---|
| | | | | | Peak M.W. | | Areal ratio | Acid value of fraction | |
| No. | Acid value | OH value | Molecular weight Mn | Molecular weight Mw | Peak 1 | Peak 2 | ($\leqq 4.5 \times 10^3$/ $>4.5 \times 10^3$) | $\leqq 4.5 \times 10^3$ | $>4.5 \times 10^3$ |
| 27 | 20.0 | 0 | 2,800 | 41,000 | 4,000 | 45,000 | 3.8 | 21.5 | 14.4 |
| 28 | 20.0 | 0 | 2,700 | 43,000 | 4,200 | 53,000 | 3.7 | 22.9 | 9.4 |
| 29 | 20.0 | 0 | 2,900 | 55,000 | 4,000 | 90,000 | 3.5 | 21.9 | 13.5 |
| 30 | 20.0 | 0 | 2,800 | 100,000 | 3,400 | 320,000 | 3.6 | 21.7 | 13.8 |
| 31 | 20.0 | 0 | 2,600 | 95,000 | 2,800 | 220,000 | 2.9 | 24.2 | 7.8 |
| 32 | 20.0 | 0 | 21,000 | 350,000 | 11,000 | 860,000 | 3.8 | 21.5 | 14.4 |
| 33 | 20.0 | 0 | 18,000 | 170,000 | 7,000 | 320,000 | 0.20 | 48.0 | 14.4 |
| 34 | 20.0 | 0 | 20,000 | 210,000 | 6,500 | 400,000 | 0.30 | 43.3 | 13.0 |
| 35 | 20.0 | 0 | 19,500 | 180,000 | 6,000 | 380,000 | 0.40 | 35.0 | 14.0 |
| 36 | 20.0 | 0 | 17,000 | 230,000 | 6,800 | 370,000 | 0.45 | 32.2 | 14.5 |
| 37 | 20.0 | 0 | 4,300 | 295,000 | 6,500 | 780,000 | 20.0 | 20.5 | 10.5 |
| 38 | 20.0 | 0 | 4,500 | 310,000 | 6,700 | 670,000 | 18.0 | 20.0 | 19.0 |
| 39 | 20.0 | 0 | 5,200 | 278,000 | 6,600 | 580,000 | 7.0 | 20.6 | 16.0 |

TABLE 13

| Resin No. | Resin: Acid value | Resin: OH value | Resin: Molecular weight Mn | Resin: Molecular weight Mw | Molecular weight distribution in developer: Peak M.W. Peak 1 | Peak M.W. Peak 2 | Areal ratio (≦4.5 × $10^3$/>4.5 × $10^3$) | Acid value of fraction ≦4.5 × $10^3$ | Acid value of fraction >4.5 × $10^3$ |
|---|---|---|---|---|---|---|---|---|---|
| 40 | 20.0 | 0 | 5,800 | 238,000 | 6,900 | 570,000 | 5.5 | 20.1 | 19.5 |
| 41 | 20.0 | 0 | 2,800 | 99,000 | 4,000 | 220,000 | 3.2 | 22.3 | 12.6 |
| 42 | 20.0 | 0 | 10,500 | 1,530,000 | 8,000 | 950,000 | 4.1 | 21.1 | 15.3 |
| 43 | 20.0 | 0 | 12,000 | 1,270,000 | 8,100 | 980,000 | 4.2 | 19.8 | 20.8 |
| 44 | 20.0 | 0 | 19,000 | 188,000 | — | 85,000 | 0.40 | 15.0 | 21.3 |
| 45 | 20.0 | 0 | 7,400 | 24,000 | 15,000 | — | 7.0 | 21.7 | 8.0 |
| 46 | 3.0 | 25.0 | 10,000 | 110,000 | 7,000 | 750,000 | 4.2 | 3.7 | 0.2 |

TABLE 14

| Material*1 | OH value (acid value) | OH value X (or Y) | Molecular weight Mn | Molecular weight Mw | Molecular weight Mw/Mn | m.p.*2 (° C.) | Content*3 (wt %) |
|---|---|---|---|---|---|---|---|
| α-1 | 70 | 48 | 440 | 870 | 2.0 | 108 | 60 |
| α-2 | 90 | 38 | 280 | 800 | 2.9 | 100 | 58 |
| α-3 | 22 | 170 | 1,800 | 3,900 | 2.2 | 115 | 96 |
| α-4 | 12 | 210 | 2,300 | 4,300 | 1.9 | 135 | 98 |
| α-5 | 28 | 120 | 1,600 | 7,700 | 4.8 | 105 | 92 |
| α-6 | 65 | 52 | 620 | 2,000 | 3.2 | 110 | 57 |
| α-7 | 98 | 38 | 230 | 580 | 2.5 | 98 | 58 |
| α-8 | 118 | 36 | 170 | 780 | 4.6 | 92 | 50 |
| α-9 | 122 | 28 | 240 | 530 | 2.2 | 88 | 35 |
| α-10 | 78 | 52 | 370 | 2,200 | 5.9 | 100 | 48 |
| α-11 | 4 | 260 | 2,700 | 8,400 | 3.1 | 150 | 99 |
| α-12 | 155 | 22 | 140 | 370 | 2.6 | 75 | 30 |
| α-13 | 1 | 320 | 4,100 | 11,000 | 2.7 | 165 | 99 |
| β-4 | (70) | (48) | 450 | 1,100 | 2.4 | 110 | 58 |
| β-2 | (55) | (60) | 670 | 1,500 | 2.2 | 115 | 65 |
| β-3 | (22) | (140) | 1,600 | 3,000 | 1.9 | 140 | 95 |

*1α-1 to 13: Longchain alkyl alcohol
β-2 to 4: Longchain alkyl carboxylic acid
*2m.p. = melting point
*3Content (wt. %) of long-chain alkyl alcohol having 37 or more carbon atoms or long-chain alkyl carboxylic acid having 38 or more carbon atoms.

EXAMPLE 29

| | |
|---|---|
| Resin 1 | 100 wt. parts |
| Magnetic iron oxide (average particle size (Dav.) = 0.15 μm, Hc = 115 oersted, $\sigma_s$ = 80 emu/g, $\sigma_r$ = 11 emu/g) | 90 wt. parts |
| Long-chain alkyl alcohol (α-1) of Formula (3) (x = 48, OH value = 70, Mn = 440, Mw = 870, Mw/Mn = 2.0, m.p. = 108° C., alcohol (≧$C_{37}$) content = 60 wt. %) | 5 wt. parts |
| Mono-azo metal complex | 2 wt. parts |

(negative charge control agent)

The above ingredients were pre-mixed by a Henschel mixer and melt-kneaded through a twin-screw extruder at 130° C. After cooling, the melt-kneaded product was coarsely crushed by a cutter mill and finely pulverized by a jet stream pulverizer, followed by classification by a pneumatic classifier to obtain a magnetic toner having a weight-average particle size of 6.2 μm. To 100 wt. parts of the magnetic toner, 1.0 wt. part of hydrophobic dry-process silica (BET specific surface area ($S_{BET}$)=300 $m^2$/g) was externally added to obtain a magnetic toner.

The magnetic toner was charged into a digital copying machine ("GP-55", mfd. by Canon K. K.) to be evaluated with respect image characteristics, whereby good results as shown in Table 21 appearing hereinafter were obtained. Further, a fixing test was performed by taking out the fixing apparatus of the copying machine so as to use it as an externally driven fixing apparatus equipped with a temperature controller at various fixing speeds, whereby good results also as shown in Table 21 were obtained.

As for the image characteristic evaluation, the density gradation characteristic was good because of a fast charging speed and a stable saturation charge. Accompanying this, an undesirable phenomenon of selective development that a developer faction of a small particle size is selectively consumed could be obviated. The halftone images were free from change in image quality from the initial stage, free from density irregularity, smooth and good.

EXAMPLES 30 –87

Magnetic toners were prepared and evaluated in the same manner as in Example 29 except that the binder resin, long-chain alkyl alcohol and long-chain alkyl carboxylic acid were changed as shown in Tables 15–19, whereby good results as shown in Tables 21–26 were obtained. The particle size of the toner after copying of 20,000 sheets was not substantially different from that in initial stage, and good image characteristic were continually obtained.

Comparative Examples 12–25

Magnetic toners were prepared and evaluated in the same manner as in Example 29 except that the binder resin, long-chain alkyl alcohol and long-chain alkyl carboxylic acid were changed as shown in Table 20, whereby results as shown in Tables 28 and 29 were obtained.

EXAMPLE 88

| | |
|---|---|
| Classified fine powder obtained in Example 29 | 60 wt. parts |
| Resin 1 | 100 wt. parts |
| Magnetic iron oxide used in Example 29 | 90 wt. parts |
| Long-chain alkyl alcohol (α-1) used in Example 29 | 5 wt. parts |
| Monoazo metal complex used in Example 29 | 2 wt. parts |

A magnetic toner was prepared and evaluated in the same manner as in Example 29, whereby good results as shown in Table 26 were obtained.

EXAMPLES 89–91

A toner reproduction process similarly as in Example 88 was repeated three times by using the classified fine powders obtained in Examples 31, 68 and 71, respectively, in combination with the materials including Resin 9 used in Examples 31, 68 and 71, respectively, whereby good results as shown in Table 27 were obtained.

Comparative Examples 26 and 27

A toner reproduction process similarly as in Example 88 was repeated two times by using the classified fine powders obtained in Comparative Examples 13 and 25, respectively, in combination with the materials used in Comparative Examples 13 and 25, respectively, whereby results as shown in Table 29 were obtained. Thus, the toners prepared in these Comparative Examples (i.e., prepared by re-utilizing the classified fine powders in Comparative Examples 13 and 25) showed worse chargeability and further inferior image qualities than in Comparative Examples 13 and 25.

TABLE 15

| | Binder resin (100 wt. parts) | | | Alcohol or carboxylic acid | | | Formula $(1)_F$ or/and $(2)_F$ | | |
|---|---|---|---|---|---|---|---|---|---|
| Example | Name | Acid value | OH value | Name | Amount wt. parts | OH or acid value | Left side (A) | Right side (B) | (A) − (B) |
| 29 | 1 | 17 | 0 | α-1 | 5 | 70 | 20 | 0 | +20 |
| 30 | 8 | 11.0 | 0 | α-1 | 5 | 70 | 14 | 0 | +14 |
| 31 | 9 | 25.0 | 0 | α-1 | 5 | 70 | 27 | 0 | +27 |
| 32 | 10 | 48.0 | 0 | α-1 | 5 | 70 | 49 | 0 | +49 |
| 33 | 6 | 5.5 | 0 | α-1 | 5 | 70 | 9 | 0 | +9 |
| 34 | 7 | 8.0 | 0 | α-1 | 5 | 70 | 11 | 0 | +11 |
| 35 | 11 | 52.0 | 0 | α-1 | 5 | 70 | 53 | 0 | +53 |
| 36 | 12 | 58.0 | 0 | α-1 | 5 | 70 | 59 | 0 | +59 |
| 37 | 5 | 3.0 | 0 | α-1 | 5 | 70 | 6 | 0 | +6 |
| 38 | 13 | 62.0 | 0 | α-1 | 5 | 70 | 62 | 0 | +62 |
| 39 | 16 | 20.0 | 17.0 | α-1 | 5 | 70 | 22 | 4 | +18 |
| 40 | 17 | 20.0 | 25.0 | α- 1 | 5 | 70 | 22 | 6 | +16 |
| 41 | 18 | 20.0 | 32.0 | α- 1 | 5 | 70 | 22 | 8 | +14 |

TABLE 16

| | Binder resin (100 wt. parts) | | | Alcohol or carboxylic acid | | | Formula $(1)_F$ or/and $(2)_F$ | | |
|---|---|---|---|---|---|---|---|---|---|
| Example | Name | Acid value | OH value | Name | Amount wt. parts | OH or acid value | Left side (A) | Right side (B) | (A) − (B) |
| 42 | 19 | 20.0 | 38.0 | α-1 | 5 | 70 | 22 | 9 | +13 |
| 43 | 26 | 20.0 | 0 | α-1 | 5 | 70 | 22 | 0 | +22 |
| 44 | 30 | 20.0 | 0 | α-1 | 5 | 70 | 22 | 0 | +22 |
| 45 | 23 | 20.0 | 0 | α-1 | 5 | 70 | 22 | 0 | +22 |
| 46 | 29 | 20.0 | 0 | α-1 | 5 | 70 | 22 | 0 | +22 |
| 47 | 21 | 20.0 | 0 | α-1 | 5 | 70 | 22 | 0 | +22 |
| 48 | 25 | 20.0 | 0 | α-1 | 5 | 70 | 22 | 0 | +22 |
| 49 | 28 | 20.0 | 0 | α-1 | 5 | 70 | 22 | 0 | +22 |
| 50 | 31 | 20.0 | 0 | α-1 | 5 | 70 | 22 | 0 | +22 |
| 51 | 32 | 20.0 | 0 | α-1 | 5 | 70 | 22 | 0 | +22 |

TABLE 16-continued

| | Binder resin (100 wt. parts) | | | Alcohol or carboxylic acid | | | Formula $(1)_f$ or/and $(2)_f$ | | |
|---|---|---|---|---|---|---|---|---|---|
| Example | Name | Acid value | OH value | Name | Amount wt. parts | OH or acid value | Left side (A) | Right side (B) | (A) − (B) |
| 52 | 41 | 20.0 | 0 | α-1 | 5 | 70 | 22 | 0 | +22 |
| 53 | 43 | 20.0 | 0 | α-1 | 5 | 70 | 22 | 0 | +22 |
| 54 | 36 | 20.0 | 0 | α-1 | 5 | 70 | 22 | 0 | +22 |

TABLE 17

| | Binder resin (100 wt. parts) | | | Alcohol or carboxylic acid | | | Formula $(1)_f$ or/and $(2)_f$ | | |
|---|---|---|---|---|---|---|---|---|---|
| Example | No. | Acid value | OH value | Name | Amount wt. parts | OH or acid value | Left side (A) | Right side (B) | (A) − (B) |
| 55 | 40 | 20.0 | 0 | α-1 | 5 | 70 | 22 | 0 | +22 |
| 56 | 35 | 20.0 | 0 | α-1 | 5 | 70 | 22 | 0 | +22 |
| 57 | 39 | 20.0 | 0 | α-1 | 5 | 70 | 22 | 0 | +22 |
| 58 | 34 | 20.0 | 0 | α-1 | 5 | 70 | 22 | 0 | +22 |
| 59 | 38 | 20.0 | 0 | α-1 | 5 | 70 | 22 | 0 | +22 |
| 60 | 46 | 3.0 | 25.0 | α-2 | 5 | 90 | 7 | 6 | +1 |
| 61 | 46 | 3.0 | 25.0 | α-2 | 10 | 90 | 11 | 6 | +5 |
| 62 | 46 | 3.0 | 25.0 | α-2 | 15 | 90 | 14 | 5 | +9 |
| 63 | 46 | 3.0 | 25.0 | α-2 | 20 | 90 | 18 | 5 | +13 |
| 64 | 9 | 25.0 | 0 | α-2 | 5 | 90 | 28 | 0 | +28 |
| 65 | 9 | 25.0 | 0 | α-3 | 5 | 22 | 25 | 0 | +25 |
| 66 | 9 | 25.0 | 0 | α-4 | 5 | 12 | 24 | 0 | +24 |
| 67 | 9 | 25.0 | 0 | α-5 | 5 | 28 | 25 | 0 | +25 |

TABLE 18

| | Binder resin (100 wt. parts) | | | Alcohol or carboxylic acid | | | Formula $(1)_f$ or/and $(2)_f$ | | |
|---|---|---|---|---|---|---|---|---|---|
| Example | No. | Acid value | OH value | Name | Amount wt. parts | OH or acid value | Left side (A) | Right side (B) | (A) − (B) |
| 68 | 9 | 25.0 | 0 | α-6 | 5 | 65 | 27 | 0 | +27 |
| 69 | 9 | 25.0 | 0 | α-7 | 5 | 105 | 29 | 0 | +29 |
| 70 | 9 | 25.0 | 0 | α-8 | 5 | 120 | 30 | 0 | +30 |
| 71 | 9 | 25.0 | 0 | β-4 | 5 | 90 | 28 | 0 | +28 |
| 72 | 9 | 25.0 | 0 | β-2 | 5 | 55 | 26 | 0 | +26 |
| 73 | 1 | 17.0 | 0 | β-3 | 5 | 22 | 17 | 0 | +17 |
| 74 | 1 | 17.0 | 0 | α-1 | 10 | 70 | 22 | 0 | +22 |
| 75 | 1 | 17.0 | 0 | α-1 | 20 | 70 | 26 | 0 | +26 |
| 76*[1] | 1 | 17.0 | 0 | α-1 | 30 | 70 | 29 | 0 | +29 |
| 77*[2] | 1 | 17.0 | 0 | α-1 | 5 | 70 | 19 | 0 | +19 |
| | | | | γ | 3 | 0 | | | |
| 78 | 22 | 20.0 | 0 | α-1 | 5 | 70 | 22 | 0 | +22 |
| 79 | 24 | 20.0 | 0 | α-1 | 5 | 70 | 22 | 0 | +22 |
| 80 | 27 | 20.0 | 0 | α-1 | 5 | 70 | 22 | 0 | +22 |

*[1]Pulverizability in toner production step was somewhat inferior.
*[2]γ denotes the low-molecular weight ethylene/propylene copolymer (γ) used in Example 6 (Table 3).

TABLE 19

| | Binder resin (100 wt. parts) | | | Alcohol or carboxylic acid | | | Formula $(1)_f$ or/and $(2)_f$ | | |
|---|---|---|---|---|---|---|---|---|---|
| Example | No. | Acid value | OH value | Name | Amount wt. parts | OH or acid value | Left side (A) | Right side (B) | (A) − (B) |
| 81 | 42 | 20.0 | 0 | α-1 | 5 | 70 | 22 | 0 | +22 |
| 82 | 44 | 20.0 | 0 | α-1 | 5 | 70 | 22 | 0 | +22 |
| 83 | 45 | 20.0 | 0 | α-1 | 5 | 70 | 22 | 0 | +22 |
| 84 | 33 | 20.0 | 0 | α-1 | 5 | 70 | 22 | 0 | +22 |
| 85 | 37 | 20.0 | 0 | α-1 | 5 | 70 | 22 | 0 | +22 |

TABLE 19-continued

| Example | Binder resin (100 wt. parts) No. | Acid value | OH value | Alcohol or carboxylic acid Name | Amount wt. parts | OH or acid value | Formula $(1)_f$ or/and $(2)_f$ Left side (A) | Right side (B) | (A) − (B) |
|---|---|---|---|---|---|---|---|---|---|
| 86*1 | 1 | 20.0 | 0 | α-1 | 35 | 70 | 33 | 0 | +33 |
| 87 | 9 | 20.0 | 0 | α-1 | 5 | 78 | 28 | 0 | +28 |

*1Pulverizability in toner production step was further inferior than in Example 76.

TABLE 20

| Comparative Example | Binder resin (100 wt. parts) No. | Acid value | OH value | Alcohol or carboxylic acid Name | Amount wt. parts | OH or acid value | Formula $(1)_f$ or/and $(2)_f$ Left side (A) | Right side (B) | (A) − (B) |
|---|---|---|---|---|---|---|---|---|---|
| 12 | 2 | 0 | 4 | α-1 | 5 | 70 | 3 | 1 | +2 |
| 13 | 3 | 0 | 0 | α-1 | 5 | 70 | 3 | 0 | +3 |
| 14 | 4 | 2.0 | 0 | α-1 | 5 | 70 | 5 | 0 | +5 |
| 15 | 14 | 78.0 | 0 | α-1 | 5 | 70 | 78 | 0 | +78 |
| 16 | 15 | 82.0 | 0 | α-1 | 5 | 70 | 81 | 0 | +81 |
| 17 | 20 | 20.0 | 42 | α-13 | 5 | 1 | 19 | 10 | +9 |
| 18 | 46 | 6.0 | 25.0 | α-11 | 3 | 4 | 6 | 6 | 0 |
| 19*1 | 9 | 25.0 | 0 | γ | 5 | 0 | 24 | 0 | +24 |
| 20 | 9 | 25.0 | 0 | α-9 | 5 | 122 | 30 | 0 | +30 |
| 21 | 9 | 25.0 | 0 | α-11 | 5 | 4 | 24 | 0 | +24 |
| 22 | 9 | 25.0 | 0 | α-12 | 5 | 155 | 31 | 0 | +31 |
| 23 | 9 | 25.0 | 0 | α-13 | 5 | 1 | 24 | 0 | +24 |
| 24 | 2 | 0 | 4 | β-1 | 10 | 70 | 6 | 1 | +5 |
| 25 | 3 | 0 | 0 | β-3 | 15 | 22 | 3 | 0 | +3 |

*1γ denotes the low-molecular weight ethylene/propylene copolymer (γ) used in Example 6 (table 3).

TABLE 21

| Ex. | Image characteristics: Initial Dmax*3 | Initial Gradation | Initial Halftone | Initial Line scatter | Initial Dav. (μm) | Initial Charge (μC/g) | After 20,000 sheets Dmax. | After 20,000 sheets Gradation | After 20,000 sheets Halftone | After 20,000 sheets Dav. (μm) | After 20,000 sheets Charge (μC/g) | E.S. | Fixing performance*4: 50 mm/sec Solid black (D = 1.4) | 50 mm/sec Halftone (D = 0.5) | 500 mm/sec Solid black (D = 1.4) | 500 mm/sec Halftone (D = 0.5) |
|---|---|---|---|---|---|---|---|---|---|---|---|---|---|---|---|---|
| 29 | ○Δ | ○ | ○ | ○ | 5.6 | −20.0 | ○ | ○ | ○ | ○ | −20.0 | ○ | ○ | ○ | ○ | ○ |
| | 1.45 | | | | | | 1.45 | | | 5.7 | | | 140° C. | | 170° C. | |
| 30 | ○ | ○ | ○ | ○ | 6.5 | −18.5 | ○ | ○ | ○ | ○ | −18.5 | ○ | ○ | ○ | ○ | ○ |
| | 1.45 | | | | | | 1.45 | | | 6.6 | | | 140° C. | | 170° C. | |
| 31 | ○ | ○ | ○ | ○ | 6.6 | −18.0 | ○ | ○ | ○ | ○ | −18.0 | ○ | ○ | ○ | ○ | ○ |
| | 1.45 | | | | | | 1.45 | | | 6.6 | | | 140° C. | | 170° C. | |
| 32 | ○ | ○ | ○ | ○ | 6.7 | −17.5 | ○ | ○ | ○ | ○ | −17.5 | ○ | ○ | ○ | ○ | ○ |
| | 1.46 | | | | | | 1.46 | | | 6.8 | | | 140° C. | | 170° C. | |
| 33 | ○ | ○ | ○ | ○ | 6.5 | −18.0 | ○ | ○ | ○Δ | ○ | −17.5 | ○Δ | ○ | ○ | ○ | ○ |
| | 1.43 | | | | | | 1.43 | | | 6.7 | | | 140° C. | | 170° C. | |
| 34 | ○ | ○ | ○ | ○ | 6.6 | −17.0 | ○ | ○ | ○ | ○ | −17.0 | ○Δ | ○ | ○ | ○ | ○ |
| | 1.44 | | | | | | 1.44 | | | 6.8 | | | 140° C. | | 170° C. | |
| 35 | ○ | ○ | ○ | ○ | 6.7 | −16.0 | ○ | ○ | ○ | ○ | −17.0 | ○Δ | ○ | ○ | ○ | ○ |
| | 1.45 | | | | | | 1.45 | | | 6.7 | | | 140° C. | | 170° C. | |
| 36 | ○ | ○ | ○ | ○ | 6.3 | −18.0 | ○ | ○ | ○ | ○ | −17.5 | ○Δ | ○ | ○ | ○ | ○ |
| | 1.43 | | | | | | 1.43 | | | 6.5 | | | 140° C. | | 170° C. | |
| 37 | ○ | ○ | ○Δ | ○ | 5.8 | −20.0 | ○ | ○Δ | ○Δ | ○Δ | −19.0 | ○Δ | ○ | ○ | ○ | ○ |
| | 1.45 | | | | | | 1.40 | | | 6.5 | | | 140° C. | | 170° C. | |
| 38 | ○ | ○ | ○Δ | ○Δ | 6.2 | −18.8 | ○Δ | ○Δ | ○Δ | ○Δ | −18.0 | Δ | ○ | ○ | ○ | ○ |
| | 1.40 | | | | | | 1.35 | | | 7.0 | | | 140° C. | | 170° C. | |

Notes are found after Table 9.

TABLE 22

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 39 | ○ | ○ | ○ | ○ | 6.4 | −18.5 | ○ | ○ | ○ | ○ | −18.5 | ○ | ○ | ○ | ○ | ○ |
| | 1.45 | | | | | | 1.45 | | | 6.7 | | | 140° C. | | 170° C. | |
| 40 | ○ | ○ | ○ | ○ | 6.5 | −18.0 | ○ | ○ | ○Δ | ○ | −18.2 | ○Δ | ○ | ○ | ○ | ○ |
| | 1.45 | | | | | | 1.42 | | | 6.6 | | | 140° C. | | 170° C. | |
| 41 | ○ | ○ | ○Δ | ○ | 6.5 | −18.2 | ○ | ○Δ | ○Δ | ○ | −18.0 | ○Δ | ○ | ○ | ○ | ○ |
| | 1.42 | | | | | | 1.40 | | | 6.6 | | | 140° C. | | 170° C. | |
| 42 | ○ | ○ | ○Δ | ○Δ | 6.7 | −18.0 | ○Δ | ○Δ | ○Δ | ○ | −17.5 | Δ | ○ | ○ | ○ | ○ |
| | 1.40 | | | | | | 1.35 | | | 7.3 | | | 140° C. | | 170° C. | |
| 43 | ○ | ○ | ○ | ○ | 6.5 | −18.0 | ○ | ○ | ○ | ○ | −18.0 | ○Δ | ○ | ○ | ○ | ○Δ |
| | 1.42 | | | | | | 1.42 | | | 6.6 | | | 140° C. | | 185° C. | |
| 44 | ○ | ○ | ○ | ○ | 6.7 | −17.6 | ○ | ○ | ○Δ | ○ | −17.7 | ○Δ | ○ | ○ | ○ | ○ |
| | 1.43 | | | | | | 1.43 | | | 6.8 | | | 140° C. | | 170° C. | |
| 45 | ○ | ○ | ○ | ○ | 6.6 | −18.0 | ○ | ○ | ○Δ | ○ | −18.0 | ○Δ | ○ | ○ | ○ | ○Δ |
| | 1.44 | | | | | | 1.44 | | | 6.7 | | | 140° C. | | 180° C. | |
| 46 | ○ | ○ | ○Δ | ○ | 6.7 | −17.7 | ○ | ○ | ○Δ | ○ | −17.7 | ○Δ | ○ | ○ | ○ | ○ |
| | 1.45 | | | | | | 1.45 | | | 6.8 | | | 140° C. | | 170° C. | |
| 47 | ○ | ○ | ○Δ | ○Δ | 6.8 | −17.0 | ○Δ | ○Δ | ○Δ | ○ | −17.0 | ○Δ | ○ | ○Δ | ○ | ○Δ |
| | 1.43 | | | | | | 1.38 | | | 7.0 | | | 150° C. | | 185° C. | |
| 48 | ○ | ○ | ○Δ | ○Δ | 6.4 | −17.5 | ○ | ○Δ | ○Δ | ○ | −17.5 | ○Δ | ○ | ○Δ | ○ | ○Δ |
| | 1.40 | | | | | | 1.40 | | | 6.4 | | | 150° C. | | 185° C. | |

Notes are found after Table 9.

TABLE 23

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 49 | ○ | ○ | ○Δ | ○Δ | 6.5 | −17.5 | ○ | ○Δ | ○Δ | ○ | −17.5 | ○Δ | ○ | ○ | ○ | ○ |
| | 1.42 | | | | | | 1.42 | | | 6.5 | | | 140° C. | | 170° C. | |
| 50 | ○ | ○ | ○Δ | ○Δ | 6.3 | −18.0 | ○Δ | ○Δ | ○Δ | ○Δ | −18.3 | Δ | ○ | ○ | ○ | ○ |
| | 1.44 | | | | | | 1.39 | | | 7.0 | | | 140° C. | | 170° C. | |
| 51 | ○ | ○ | ○ | ○ | 6.0 | −19.5 | ○ | ○Δ | ○Δ | ○ | −19.5 | ○Δ | ○ | ○Δ | ○ | ○Δ |
| | 1.45 | | | | | | 1.45 | | | 6.1 | | | 155° C. | | 185° C. | |
| 52 | ○ | ○ | ○ | ○ | 6.2 | −18.2 | ○ | ○Δ | ○Δ | ○ | −18.2 | ○Δ | ○ | ○ | ○ | ○ |
| | 1.43 | | | | | | 1.43 | | | 6.2 | | | 140° C. | | 170° C. | |
| 53 | ○ | ○ | ○ | ○Δ | 6.5 | −17.6 | ○ | ○ | ○Δ | ○ | −17.6 | ○Δ | ○ | ○Δ | ○ | ○Δ |
| | 1.44 | | | | | | 1.44 | | | 6.5 | | | 155° C. | | 185° C. | |
| 54 | ○ | ○ | ○ | ○ | 6.7 | −17.8 | ○ | ○ | ○ | ○ | −17.8 | ○ | ○ | ○ | ○ | ○ |
| | 1.46 | | | | | | 1.46 | | | 6.7 | | | 140° C. | | 170° C. | |
| 55 | ○ | ○ | ○ | ○ | 6.4 | −18.0 | ○ | ○ | ○ | ○ | −18.0 | ○ | ○ | ○ | ○ | ○ |
| | 1.43 | | | | | | 1.43 | | | 6.5 | | | 140° C. | | 170° C. | |
| 56 | ○ | ○ | ○ | ○ | 6.3 | −19.0 | ○ | ○ | ○ | ○ | −19.0 | ○Δ | ○ | ○Δ | ○Δ | ○Δ |
| | 1.45 | | | | | | 1.44 | | | 6.5 | | | 155° C. | | 190° C. | |
| 57 | ○ | ○ | ○ | ○ | 6.6 | −18.0 | ○ | ○ | ○ | ○ | −18.0 | ○Δ | ○ | ○ | ○ | ○ |
| | 1.44 | | | | | | 1.44 | | | 6.7 | | | 140° C. | | 165° C. | |
| 58 | ○ | ○ | ○Δ | ○Δ | 6.3 | −17.5 | ○ | ○Δ | ○Δ | ○Δ | −16.7 | Δ | ○Δ | ○Δ | ○Δ | Δ |
| | 1.43 | | | | | | 1.39 | | | 7.0 | | | 160° C. | | 190° C. | |

Notes are found after Table 9.

TABLE 24

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 59 | ○ | ○ | ○Δ | ○Δ | 6.5 | −17.6 | ○ | ○Δ | ○Δ | ○Δ | −17.0 | Δ | ○ | ○ | ○ | ○ |
| | 1.45 | | | | | | 1.43 | | | 7.2 | | | 140° C. | | 170° C. | |
| 60 | ○ | ○ | ○Δ | ○Δ | 6.6 | −17.2 | ○ | ○Δ | ○Δ | ○Δ | −16.5 | Δ | ○ | ○ | ○ | ○ |
| | 1.40 | | | | | | 1.38 | | | 7.2 | | | 140° C. | | 170° C. | |
| 61 | ○ | ○ | ○Δ | ○Δ | 6.2 | −18.2 | ○ | ○Δ | ○Δ | ○Δ | −17.3 | ○Δ | ○ | ○ | ○ | ○ |
| | 1.43 | | | | | | 1.40 | | | 6.9 | | | 140° C. | | 170° C. | |
| 62 | ○ | ○ | ○ | ○ | 6.0 | −19.5 | ○ | ○Δ | ○Δ | ○ | −19.2 | ○Δ | ○ | ○ | ○ | ○ |
| | 1.45 | | | | | | 1.44 | | | 6.0 | | | 140° C. | | 170° C. | |
| 63 | ○ | ○ | ○ | ○ | 5.8 | −20.0 | ○ | ○ | ○ | ○ | −20.0 | ○Δ | ○ | ○ | ○ | ○ |
| | 1.45 | | | | | | 1.45 | | | 5.9 | | | 140° C. | | 170° C. | |
| 64 | ○ | ○ | ○ | ○ | 6.2 | −19.2 | ○ | ○ | ○ | ○ | −19.2 | ○ | ○ | ○ | ○ | ○ |
| | 1.45 | | | | | | 1.45 | | | 6.3 | | | 140° C. | | 170° C. | |
| 65 | ○ | ○ | ○ | ○ | 6.6 | −18.8 | ○ | ○ | ○ | ○ | −18.8 | ○ | ○ | ○ | ○ | ○ |
| | 1.45 | | | | | | 1.45 | | | 6.6 | | | 140° C. | | 170° C. | |
| 66 | ○ | ○ | ○ | ○ | 6.7 | −17.3 | ○ | ○Δ | ○Δ | ○ | −17.2 | ○Δ | ○ | ○ | ○ | ○Δ |
| | 1.45 | | | | | | 1.45 | | | 6.8 | | | 150° C. | | 185° C. | |
| 67 | ○ | ○ | ○ | ○Δ | 6.5 | −18.0 | ○Δ | ○Δ | ○Δ | ○ | −18.0 | ○Δ | ○ | ○ | ○ | ○ |
| | 1.45 | | | | | | 1.38 | | | 6.5 | | | 140° C. | | 170° C. | |
| 68 | ○ | ○ | ○ | ○ | 6.4 | −18.0 | ○ | ○ | ○Δ | ○ | −18.0 | ○Δ | ○ | ○ | ○ | ○ |
| | 1.44 | | | | | | 1.44 | | | 6.5 | | | 140° C. | | 170° C. | |

Notes are found after Table 9.

TABLE 25

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 69 | ○ | ○ | ○ | ○Δ | 6.5 | −18.0 | ○ | ○ | ○Δ | ○ | −18.0 | ○Δ | ○ | ○ | ○ | ○ |
| | 1.45 | | | | | | 1.44 | | | 6.5 | | | 140° C. | | 170° C. | |
| 70 | ○ | ○ | ○Δ | ○Δ | 6.4 | −18.0 | ○Δ | ○Δ | ○Δ | ○ | −17.2 | ○Δ | ○ | ○ | ○ | ○ |
| | 1.43 | | | | | | 1.37 | | | 6.5 | | | 140° C. | | 170° C. | |
| 71 | ○ | ○ | ○ | ○ | 6.3 | −18.5 | ○ | ○ | ○ | ○Δ | −17.2 | ○ | ○ | ○ | ○ | ○ |
| | 1.43 | | | | | | 1.40 | | | 7.0 | | | 140° C. | | 175° C. | |
| 72 | ○ | ○ | ○ | ○Δ | 6.5 | −18.0 | ○ | ○ | ○ | ○Δ | −16.7 | ○ | ○ | ○ | ○ | ○Δ |
| | 1.43 | | | | | | 1.40 | | | 7.2 | | | 150° C. | | 180° C. | |
| 73 | ○ | ○ | ○Δ | ○Δ | 6.6 | −17.5 | ○ | ○ | ○ | ○Δ | −16.4 | ○ | ○ | ○Δ | ○ | ○Δ |
| | 1.44 | | | | | | 1.40 | | | 7.4 | | | 155° C. | | 180° C. | |
| 74 | ○ | ○ | ○ | ○ | 6.5 | −18.0 | ○ | ○ | ○ | ○ | −18.0 | ○ | ○ | ○ | ○ | ○ |
| | 1.42 | | | | | | 1.42 | | | 6.5 | | | 140° C. | | 170° C. | |
| 75*8 | ○ | ○ | ○ | ○ | 6.5 | −18.3 | ○ | ○ | ○ | ○ | −18.3 | ○ | ○ | ○ | ○ | ○ |
| | 1.44 | | | | | | 1.44 | | | 6.5 | | | 140° C. | | 170° C. | |
| 76 | ○ | ○ | ○ | ○Δ | 6.6 | −18.2 | ○ | ○ | ○Δ | ○ | −18.0 | ○Δ | ○Δ | ○Δ | ○ | ○ |
| | 1.45 | | | | | | 1.45 | | | 6.8 | | | 160° C. | | 180° C. | |
| 77 | ○ | ○ | ○ | ○ | 6.5 | −18.5 | ○ | ○ | ○ | ○ | −18.5 | ○ | ○ | ○ | ○ | ○ |
| | 1.44 | | | | | | 1.44 | | | 6.7 | | | 140° C. | | 170° C. | |
| 78 | ○ | ○Δ | ○Δ | ○Δ | 6.5 | −17.0 | ○Δ | ○Δ | ○Δ | ○ | −16.8 | ○Δ | ○Δ | ○Δ | ○Δ | ○Δ |
| | 1.42 | | | | | | 1.38 | | | 7.0 | | | 160° C. | | 190° C. | |

Notes are found after Table 9.

TABLE 26

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 79 | ○ 1.40 | ○Δ | ○Δ | ○Δ | 6.5 | −17.0 | ○Δ 1.38 | ○Δ | ○Δ | ○ 7.0 | −17.5 | ○Δ | ○Δ 160° C. | ○Δ | ○Δ 190° C. | ○Δ |
| 80 | ○ 1.40 | ○Δ | ○Δ | ○Δ | 6.5 | −16.5 | ○Δ 1.38 | ○Δ | ○Δ | ○ 7.5 | −19.0 | Δ | ○ 145° C. | ○ | ○ 170° C. | ○ |
| 81 | ○ 1.41 | ○Δ | ○Δ | ○Δ | 6.4 | −17.0 | ○Δ 1.38 | ○Δ | ○Δ | ○ 6.8 | −16.8 | ○Δ | ○Δ 160° C. | ○Δ | ○Δ 190° C. | ○Δ |
| 82 | ○ 1.42 | ○Δ | ○Δ | ○Δ | 6.5 | −17.0 | ○Δ 1.36 | ○Δ | ○Δ | Δ 7.5 | −19.2 | ○Δ | ○Δ 160° C. | Δ | ○Δ 190° C. | Δ |
| 83 | ○ 1.40 | ○Δ | ○Δ | ○Δ | 6.5 | −17.2 | Δ 1.33 | Δ | Δ | Δ 7.6 | −19.5 | Δ | ○ 145° C. | ○ | ○ 170° C. | ○ |
| 84 | ○ 1.40 | ○Δ | ○Δ | ○Δ | 6.4 | −17.8 | Δ 1.33 | Δ | Δ | Δ 7.6 | −20.0 | Δ | Δ 165° C. | Δ | ○Δ 190° C. | Δ |
| 85 | ○ 1.40 | ○Δ | ○Δ | ○Δ | 6.5 | −17.0 | ○Δ 1.37 | Δ | Δ | Δ 7.7 | −20.0 | Δ | ○ 140° C. | ○ | ○ 180° C. | ○ |
| 86*5 | ○ 1.45 | ○Δ | ○Δ | ○Δ | 8.5 | −16.0 | ○ 1.40 | Δ | Δ | Δ 10.0 | −13.0 | ○Δ | ○Δ 160° C. | ○Δ | ○Δ 190° C. | ○Δ |
| 87 | ○ 1.43 | ○Δ | ○Δ | ○Δ | 6.5 | −15.0 | Δ 1.33 | Δ | Δ | Δ 7.5 | −18.0 | Δ | ○ 150° C. | ○ | ○ 180° C. | ○ |
| 88 | ○ 1.45 | ○ | ○ | ○ | ○ 5.7 | −20.1 | ○ 1.45 | ○ | ○ | ○ 5.7 | −20.1 | ○ | ○ 140° C. | ○ | ○ 170° C. | ○ |

Notes are found after Table 9.

TABLE 27

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 89 | ○ 1.45 | ○ | ○ | ○ | ○ 6.5 | −18.0 | ○ 1.45 | ○ | ○ | ○ 6.5 | −18.0 | ○ | ○ 140° C. | ○ | ○ 170° C. | ○ |
| 90 | ○ 1.45 | ○ | ○ | ○ | ○ 6.5 | −19.0 | ○ 1.45 | ○ | ○ | ○ 6.6 | −19.0 | ○ | ○ 140° C. | ○ | ○ 170° C. | ○ |
| 91 | ○ 1.43 | ○ | ○ | ○ | ○ 6.5 | −17.5 | ○ 1.40 | ○ | ○ | ○Δ 7.0 | ○Δ −16.8 | ○ | ○ 140° C. | ○ | ○ 175° C. | ○ |

Notes are found after Table 9.

TABLE 28

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Comp. Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 12 | Δ 1.30 | Δ | Δ | Δ | 6.5 | −15.0 | Δ 1.28 | ΔX | ΔX | ○Δ 7.0 | Δ −12.0 | ΔX | ○ 150° C. | ○ | ○ 180° C. | ○ |
| 13 | Δ 1.32 | Δ | Δ | Δ | 6.5 | −14.0 | Δ 1.29 | ΔX | ΔX | ○ 6.8 | Δ −24.0 | ΔX | ○ 150° C. | ○ | ○ 180° C. | ○ |
| 14 | Δ 1.33 | Δ | Δ | Δ | 6.5 | −14.5 | Δ 1.27 | ΔX | ΔX | ○Δ 7.0 | Δ −25.0 | ΔX | ○ 150° C. | ○ | ○ 180° C. | ○ |
| 15 | ΔX 1.20 | ΔX | Δ | Δ | 6.6 | −13.8 | X 1.17 | X | X | ○Δ 7.2 | Δ −22.0 | X | ○ 150° C. | ○ | ○ 180° C. | ○ |
| 16 | ΔX 1.25 | ΔX | Δ | Δ | 6.7 | −14.0 | X 1.22 | X | X | ○Δ 7.5 | Δ −21.0 | X | ○ 150° C. | ○ | ○ 180° C. | ○ |

TABLE 28-continued

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Comp. Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 17 | X<br>1.17 | X | X | X | 6.5 | −10.0 | X<br>1.15 | X | X | Δ<br>7.5 | Δ<br>−20.0 | X | ○<br>150° C. | ○ | ○<br>180° C. | ○ |
| 18 | Δ<br>1.28 | ΔX | ΔX | ΔX | 6.5 | −15.0 | ΔX<br>1.18 | X | X | Δ<br>8.5 | X<br>−25.0 | X | ○<br>150° C. | ○ | ○<br>175° C. | ○ |
| 19 | ○<br>1.42 | ○Δ | Δ | Δ | 6.5 | −16.5 | Δ<br>1.25 | ΔX | ΔX | Δ<br>8.5 | X<br>−22.0 | Δ | ○Δ<br>160° C. | ○Δ | ○Δ<br>185° C. | ○Δ |
| 20 | ○<br>1.40 | ○Δ | ○Δ | Δ | 6.5 | −17.5 | | | *7 | | | X | ○<br>150° C. | ○ | ○<br>180° C. | ○ |
| 21 | ΔX<br>1.25 | ΔX | ΔX | ΔX | 6.5 | −16.5 | X<br>1.18 | X | ΔX | X<br>8.3 | ΔX<br>−14.0 | ΔX | ○<br>150° C. | ○ | ○<br>180° C. | ○ |

Notes are found after Table 9.

TABLE 29

| | Image characteristics | | | | | | | | | | | | Fixing performance*4 | | | |
|---|---|---|---|---|---|---|---|---|---|---|---|---|---|---|---|---|
| | | | | | | | | | | | | | 50 mm/sec | | 500 mm/sec | |
| | Initial | | | | | | After 20,000 sheets | | | | | | | | | |
| Comp. Ex. | Dmax*3 | Gra-da-tion | Half-tone | Line scat-ter | Dav. (μm) | Charge (μC/g) | Dmax. | Gra-da-tion | Half-tone | Dav. (μm) | Charge (μC/g) | E.S. | Solid black (D = 1.4) | Half-tone (D = 0.5) | Solid black (D = 1.4) | Half-tone (D = 0.5) |
| 22 | ΔX<br>1.22 | ΔX | ΔX | ΔX | 6.5 | −16.0 | | | *7 | | | X | ○<br>150° C. | ○ | ○<br>175° C. | ○ |
| 23 | ΔX<br>1.23 | ΔX | ΔX | ΔX | 6.5 | −16.2 | X<br>1.19 | X | ΔX | X<br>8.6 | Δ<br>−14.2 | ΔX | Δ<br>165° C. | ΔX | ΔX<br>195° C. | X |
| 24*8 | ○<br>1.40 | ○ | ○ | ○ | 10.0 | −17.0 | ○<br>1.43 | ○ | ○Δ | Δ<br>12.0 | Δ<br>−15.0 | ○ | ○<br>140° C. | ○ | ○<br>175° C. | ○ |
| 25*8 | ○<br>1.40 | ○ | ○ | ○ | 10.5 | −16.5 | ○<br>1.44 | ○ | ○Δ | Δ<br>12.5 | Δ<br>−14.8 | ○ | ○<br>155° C. | ○Δ | ○<br>180° C. | ○Δ |
| 26 | ΔX<br>1.20 | X | ΔX | ΔX | 6.5 | −12.2 | X<br>1.00 | X | ΔX | Δ<br>8.7 | X<br>−7.8 | ΔX | ○<br>150° C. | ○ | ○<br>180° C. | ○ |
| 27 | ΔX<br>1.20 | X | ΔX | ΔX | 6.5 | −12.0 | X<br>1.02 | X | ΔX | Δ<br>8.5 | X<br>−8.0 | ΔX | ○<br>155° C. | ○Δ | ○<br>180° C. | ○Δ |

Notes are found after Table 9.

What is claimed is:

1. A negatively chargeable magnetic toner for developing an electrostatic image comprising: toner particles, which are comprised of a magnetic material, 100 parts by weight of a binder resin, 0.5 to 20 parts by weight of a long-chain compound, and 0.1–10 parts by weight of a negative charge control agent and from 0.1 to 4 wt. parts per 100 wt. parts of the magnetic toner of a flowability improving agent carried on the surface of the toner particles, wherein the binder resin consists essentially of a polyester resin having an acid value of 10–50 mg KOH/g, obtained from a mixture of (i) diol represented by the following formula (A):

(A)

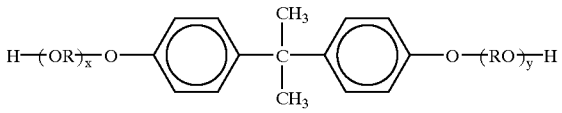

wherein R denotes an ethylene or propylene group, x and y are independently 0 or a positive integer with the proviso that the average of x+y is in the range of 0–10, (ii) dibasic acid selected from the group consisting of terephthalic acid, isophthalic acid, succinic acid, n-dodecenylsuccinic acid and fumaric acid, and (iii) trimellitic anhydride, said polyester resin has an OH value of at most 60 mg KOH/g and a number-average molecular weight (Mn) of 2,500 to 10,000, the long-chain compound comprises a long-chain alkyl alcohol having an OH value of 22–90 mg KOH/g and a weight-average molecular weight (Mw) of 800–3900, an Mw/Mn ratio of at most 2.9, and a melting point of at least 91° C., and the long-chain alkyl alcohol is represented by the following formula (3):

formula (3)

$$CH_3(CH_2)_xCH_2OH$$

wherein X is 38–170 on average, and is contained so as to satisfy a condition of the following formulae (1) and (5):

formula (1)

acid value of binder resin+OH value of long-chain alkyl alcohol>(¼)×OH value of binder resin, formula (5)

fr x (acid value of binder resin)+fa x (OH value of long-chain alkyl alcohol)—

(¼) x fr x (OH value of binder resin)

>10 wherein fr and fa denote content factors of the binder resin and long-chain alkyl alcohol, respectively, wherein fr=(R/(a+α+R) and fa=(a/(a+α+R) and R is the content of the binder resin, a is the content of the long-chain alkyl alcohol, and α is the content of THF-insoluble resinous matter other than the long-chain alkyl alcohol.

2. The toner according to claim 1, wherein the long-chain alkyl alcohol contains at least 50wt. % of a long-chain alkyl alcohol component having at least 37 carbon atoms based on the total weight of the long-chain alkyl alcohol.

3. The toner according to claim 1, wherein the polyester resin and the long-chain alkyl alcohol satisfy a condition of the following formula:

acid value of polyester resin+OH value of long-chain alkyl alcohol−(¼)×OH value of polyester resin >5.

4. The toner according to claim 3, wherein the polyester resin and the long-chain alkyl alcohol satisfy a condition of the following formula:

acid value of polyester resin+OH value of long-chain alkyl alcohol−(¼)×OH value of polyester resin >10.

5. The toner according to claim 1, wherein the polyester resin has a glass transition point of 40–90° C.

6. The toner according to claim 5, wherein the polyester resin has a glass transition point of 45–85° C.

7. The toner according to claim 1, wherein the polyester resin has a weight average molecular weight (Mw) of $3\times10^3$–$3\times10^6$.

8. The toner according to claim 7, wherein the polyester resin has an Mw of $1\times10^4$–$2.5\times10^6$.

9. The toner according to claim 8, wherein the polyester resin has an Mw of $4\times10^4$–$2\times10^6$.

10. A toner according to claim 1, wherein the value of (fr x (acid value of binder resin)+fa x (OH value of long-chain alkyl alcohol)) in the formula 5 is in the range of 21 to 90.

* * * * *

UNITED STATES PATENT AND TRADEMARK OFFICE

CERTIFICATE OF CORRECTION

PATENT NO. : 6,623,901 B1 
DATED : September 23, 2003
INVENTOR(S) : Takaaki Kohtake et al.

It is certified that error appears in the above-identified patent and that said Letters Patent is hereby corrected as shown below:

Title page,
Item [56], References Cited, U.S. PATENT DOCUMENTS, "Fox et al." should read -- Fox --.

Column 6,
Line 25, "(O _____" should read --O _____ --;
Line 26, "(C _____O)," should read --C _____O), --.

Column 7,
Line 45, ">5," should read -- ≧ 5, --;
Line 46, ">10," should read -- ≧ 10, --;
Line 66, ">5," should read -- ≧ 5, --; and
Line 67, ">10," should read -- ≧ 10, --;

Column 12,
Line 7, "that.the" should read -- that the --.

Column 13,
Line 43, "($PbFe_{12}O1_9$)," should read -- ($PbFe_{12}O_{19}$), --;
Line 54, "pm." should read -- μm. --.

Column 14,
Line 8, 'HANSA" should read -- Hansa --; and
Line 39, "a," should read -- a --.

Column 16,
Lines 36 and 37, "pm," should read -- μm, --.

Column 17,
Line 32, "$H_2NCH_2CCH_2CH_2Si$" should read -- $H_2NCH_2CH_2CH_2Si$ --; and
Line 39, "$NHCH_2CH_2CH_2$" (first occurrence) should read -- $NHCH_2CH_2$ --.

UNITED STATES PATENT AND TRADEMARK OFFICE

CERTIFICATE OF CORRECTION

PATENT NO. : 6,623,901 B1
DATED : September 23, 2003
INVENTOR(S) : Takaaki Kohtake et al.

It is certified that error appears in the above-identified patent and that said Letters Patent is hereby corrected as shown below:

Column 18,
Line 32, "$H_2NCH_2CCH_2CH_2Si$" should read -- $H_2NCH_2CH_2CH_2Si$ --;

Column 19,
Line 48, "1)1:" should read -- 1) -1: -- and "material." should read -- material --; and
Line 59, "contents)." should read -- contents) --.

Column 20,
Line 2, "extractor" should read -- extractor 20 --; and
Line 8, "heating-by" should read -- heating by --.

Column 21,
Line 37, "$(1_f$ =" should read --$(1)_f$ =--.

Column 24,
Line 53, "/OSA//" should read -- /DSA// --.

Column 30,
Line 67, "○ 150° C." should read -- ○ 140° C.--; and

"○ 175° C." should read -- ○ 170° C.--.

Column 32,
Line 56, "Δ" should read -- x --; and

Line 62, "Δx 198º C." should read -- Δx 195ºC. --.

Column 34,
Line 5, "Mw = 1 x $10^{5,}$" should read -- Mw = 1 x $10^5$, --;
Line 20, "Mn = 1.2 - $10^4$, Mw = 1.2 - $10^5$," should read
-- Mn = 1.2 x $10^4$, Mw = 1.2 x $10^5$, --; and
Line 34, "Mn = 1.0 - $10^{4,}$ Mw = 1.3 - $10^5$," should read
-- Mn = 1.0 x $10^4$, Mw = 1.3 x $10^5$, --.

UNITED STATES PATENT AND TRADEMARK OFFICE

CERTIFICATE OF CORRECTION

PATENT NO. : 6,623,901 B1 
DATED : September 23, 2003
INVENTOR(S) : Takaaki Kohtake et al.

It is certified that error appears in the above-identified patent and that said Letters Patent is hereby corrected as shown below:

Column 37,
Lines 38 and 39, “Longchain” should read -- Long-chain --.

Column 40,
Table 15, “Name” (first occurrence) should read -- No. --; and
Table 16, “Name” (first occurrence) should read -- No. --.

Column 41,
Table 16 cont., “Name” (first occurrence) should read -- No. --.

Column 53,
Line 7, “>10” should read -- ≧ 10 --; and
Line 22, “>5.” should read -- ≧ 5. --.

Column 54,
Line 5, “>10.” should read -- ≧ 10. --.

Signed and Sealed this

Sixth Day of April, 2004

JON W. DUDAS
*Acting Director of the United States Patent and Trademark Office*